US010760377B1

(12) United States Patent
Hegarty et al.

(10) Patent No.: US 10,760,377 B1
(45) Date of Patent: Sep. 1, 2020

(54) DOWNHOLE PUMP BYPASS VALVE APPARATUSES AND METHODS

(71) Applicant: Power Feed—Thru Systems & Connectors LLC, Deer Park, TX (US)

(72) Inventors: Brian Hegarty, Aberdeen (GB); Paul Lamont, Aberdeen (GB)

(73) Assignee: Power Feed-Thru Systems & Connectors LLC, Deer Park, TX (US)

( * ) Notice: Subject to any disclaimer, the term of this patent is extended or adjusted under 35 U.S.C. 154(b) by 22 days.

(21) Appl. No.: 15/639,603

(22) Filed: Jun. 30, 2017

Related U.S. Application Data

(63) Continuation-in-part of application No. 15/149,125, filed on May 7, 2016, now abandoned.

(51) Int. Cl.

| | |
|---|---|
| ***E21B 34/10*** | (2006.01) |
| ***E21B 21/10*** | (2006.01) |
| ***E21B 34/14*** | (2006.01) |
| ***E21B 34/08*** | (2006.01) |
| ***E21B 34/00*** | (2006.01) |

(52) U.S. Cl.
CPC ..... *E21B 34/10* (2013.01); *E21B 21/103* (2013.01); *E21B 34/102* (2013.01); *E21B 34/14* (2013.01); *E21B 21/10* (2013.01); *E21B 34/00* (2013.01); *E21B 34/08* (2013.01); *E21B 2200/06* (2020.05)

(58) Field of Classification Search
CPC ..... E21B 34/10; E21B 21/103; E21B 34/14; E21B 34/102; E21B 2034/007; E21B 21/10; E21B 34/00; E21B 34/08
See application file for complete search history.

(56) References Cited

U.S. PATENT DOCUMENTS

| | | | | |
|---|---|---|---|---|
| 4,469,180 A * | 9/1984 | Turner | E21B 34/10 | 166/324 |
| 8,381,820 B2 * | 2/2013 | Martinez | E21B 43/128 | 166/105 |
| 8,453,723 B2 * | 6/2013 | Smithson | E21B 23/00 | 166/65.1 |
| 2012/0125629 A1 * | 5/2012 | Churchill | E21B 21/103 | 166/373 |

* cited by examiner

*Primary Examiner* — Tara E Schimpf
*Assistant Examiner* — Jonathan Malikasim
(74) *Attorney, Agent, or Firm* — David G. Henry, Sr.

(57) ABSTRACT

Systems and methods for pressure testing of production tubing in an oil or gas well utilizing a valve having a first and second cylindrical body arranged for axial movement within a cylindrical housing. Movement within the cylindrical housing is regulated by introduction of hydraulic fluid into a cavity in the cylindrical housing and a spring. Systems and methods may further include the use of configuring the cylindrical bodies for sealing engagement with one another caused by movement of the cylindrical bodies within the cylindrical housing.

9 Claims, 12 Drawing Sheets

"PUMP ON"

"PUMP OFF"

DOWNHOLE PUMP BYPASS VALVE APPARATUSES AND METHODS

BACKGROUND

1. Field of Inventions

The field of this application and any resulting patent is downhole bypass valve apparatuses and methods.

2. Description of Related Art

Electrical submersible pumps (ESPs) are positioned downhole in oil or gas wells to assist fluid recovery in formations with low internal pressure. When the ESP is running, fluid may be drawn from the ESP intake at the formation and pumped to the surface. When the ESP is off, there are a number of reasons why it may be desirable to route fluids from the production tubing into the annulus above the ESP, rather than through the ESP. For example, scale build up and bearing wear in the ESP can be avoided by routing fluid around the ESP when the ESP is not needed for recovery. Additionally, chemical injection may be performed on a well without injecting through the ESP. Finally, when the ESP is shut down after pumping fluid to the surface, the column of fluid remaining in the production tubing can drain out to the annulus without back-flowing into the ESP. A fluid diverter valve (bypass valve) may be used to create a fluid connection between the annulus and production tubing when the ESP is not running.

Currently, at least some bypass valves operate passively as a "check valve," where the flow of fluids in the wellbore passively controls the open/closed state of the bypass valve. Pressure testing of production tubing is performed by sealing off the production tubing above the ESP. However, because the ESP is off, existing bypass valves would be open in this scenario. A seal must be made above the bypass valve before the production tubing would be in a state to pressure test. Slickline may be used to run a standing valve or plug into a seal-bore nipple to seal the production tubing above the bypass valve. However, slickline is not always available, especially in subsea wells, and running the plug or standing valve before testing and removing it afterwards adds costs and adds to downtime of the well. The inventors have recognized a need for a bypass valve capable of isolating the annulus when the ESP is not running.

Various methods and devices have been proposed and utilized for downhole bypass valves, including the methods and devices disclosed in the references appearing on the face of this patent. However, these methods and devices lack all the steps or features of the methods and devices covered by the patent claims below. Furthermore, the methods and devices covered by at least some of the claims of this issued patent solve many of the problems that prior art methods and devices have failed to solve. Also, the methods and devices covered by at least some of the claims of this patent have benefits that could be surprising and unexpected to a person of ordinary skill in the art based on the prior art existing at the time of invention.

SUMMARY

The disclosure herein includes a method for pressure testing of production tubing in an oil or gas well comprising: providing a valve capable of being coupled to an electrical submersible pump (ESP) and the production tubing downhole in the oil or gas well, wherein the valve includes: a first cylindrical body having a nose and a first channel positioned axially through the first cylindrical body and a second channel positioned radially through the first cylindrical body such that the second channel connects to the first channel; a cylindrical housing having a third channel positioned radially through the cylindrical housing that is capable of aligning with the second channel, wherein the first cylindrical body is positioned within and capable of moving axially within the cylindrical housing; and a second cylindrical body having a fourth channel positioned axially through the second cylindrical body and a radial sealing face capable of contacting the nose of the first cylindrical body to form a seal, wherein the second cylindrical body is positioned within and capable of moving axially within the cylindrical housing.

The disclosure herein also includes a method for pressure testing of production tubing in an oil or gas well comprising: providing a valve capable of being coupled to an electrical submersible pump (ESP) and the production tubing downhole in the oil or gas well, wherein the valve includes: a cylindrical housing having a first side wall and a bottom face, wherein a first channel is positioned radially through the first side wall; a first cylindrical body having a second side wall, wherein a second channel is positioned radially through the second side wall; a second cylindrical body having a third side wall, a first radial face, and a second radial face; and a cavity that is defined by the first radial face, the first side wall, and the bottom face.

The disclosure herein further includes a method for pressure testing of production tubing in an oil or gas well comprising: providing a valve capable of being coupled to an electrical submersible pump (ESP) downhole in the oil or gas well, wherein the valve includes: a cylindrical housing having a first side wall and a bottom face, wherein a first channel is positioned radially through the first side wall; a cylindrical body having a second side wall, a first radial face, and a second radial face, wherein a second channel is positioned radially through the second side wall; a cavity that is defined by the first radial face of the cylindrical body, the first side wall, and the bottom face.

DETAILED DESCRIPTION

1. Introduction

Figure 1:
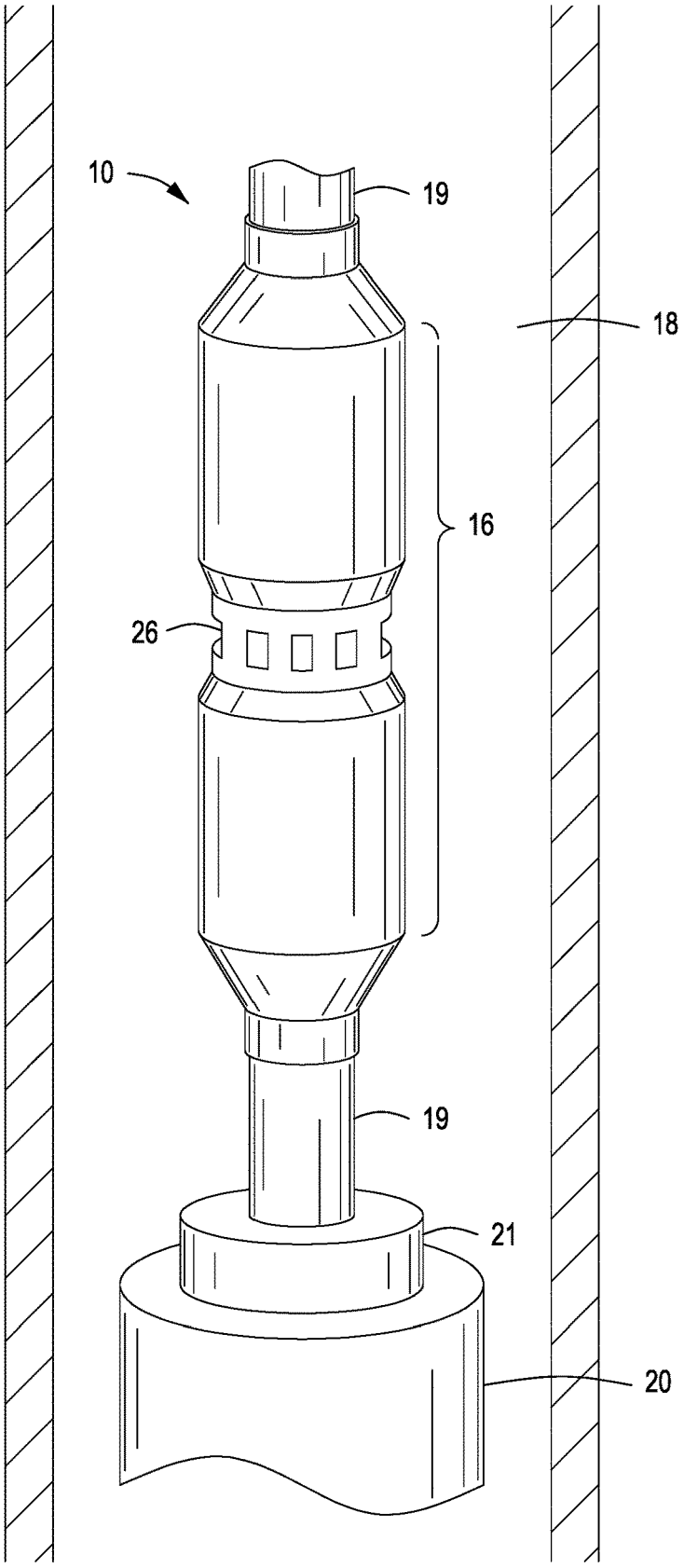
FIG. 1 is a simplified, perspective view of an ESP coupled to a hydraulic bypass valve positioned downhole.

A detailed description will now be provided. The purpose of this detailed description, which includes the drawings, is to satisfy the statutory requirements of 35 U.S.C. § 112. For example, the detailed description includes a description of the inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details of the systems, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

2. Selected Definitions

Certain claims include one or more of the following terms which, as used herein, are expressly defined below.

The term "valve" as used herein is defined as a device that is capable of controlling the flow of fluid by opening and closing. A valve may be hollow so as to allow fluid to flow through the valve. A valve may include one or more structures that may be moved to open a passage or close a passage. A valve may be capable of coupling to production tubing such that fluid flowing within the production tubing passes through at least a portion of the valve. A valve may be capable of coupling to an ESP such that fluid flowing within the ESP passes through at least a portion of the valve. A valve may include a housing that is coupled to production tubing and/or the ESP. A valve may include a housing that is fixed with respect to the production tubing and/or ESP. A valve may include one or more cylindrical bodies that are positioned within the housing and capable of moving with respect to the housing. A valve may include two or more structures capable of moving with respect to one another to open or close the valve. A valve may have an interior portion through which fluid can pass. A valve may connect the interior portion of the valve to an exterior environment when, for example, the valve is open. A valve may be capable of providing a connection between an annulus of a wellbore and production tubing of a well when the valve is open. A valve may separate an annulus of a wellbore from the production tubing of a well when the valve is closed.

The term "coupled" as used herein is defined as directly or indirectly attached to or integral with, e.g., part of. A first object may be either permanently or removably coupled to a second object. A first object may be coupled to a second object such that the first object is positioned at a specific location and orientation with respect to the second object. Thus, top and/or bottom subs may be coupled to a center housing such that the top and/or bottom sub is incapable of rotating with respect to the center housing. Two objects may be capable of being threadably coupled together, e.g., where a threaded outer surface of one object is capable of engaging with or to a threaded inner surface of the other object. A valve may be capable of coupling to a downhole component, e.g., a drilling string, by engaging a threaded end portion of the valve with a threaded end portion of the downhole component. A valve may be coupled directly to an ESP when a bottom sub of the valve includes a flange connection capable of coupling to a flange connection on the ESP. A valve may be coupled indirectly to an ESP when the valve is coupled to production tubing, e.g., through a threaded connection, and the production tubing is coupled to the ESP, e.g., through a flange connection. Two pipes may be capable of being threadably coupled together, e.g., where a threaded outer surface of one pipe is capable of engaging with or to a threaded inner surface of the other pipe, as exemplified by the connecting of pipes 112 and 132 in FIG. 9. A ring may be coupled to a pipe when a threaded portion of an outer surface of the pipe engages at least some of a threaded inner surface of the ring. A ring may be coupled to a pipe when a protrusion on an inner surface of the ring engages a slot on an outer surface of the pipe such that the ring is incapable of rotating with respect to the pipe; the ring coupled to the pipe may be capable of being moved axially along the outer surface of the pipe. A ring may be coupled to a top face or bottom face of a cylindrical body. For example, a circumferential surface of a ring may be welded to a top face or bottom face of a cylindrical body. For example, a cylindrical body may be formed (e.g., machined) with a ring protruding from a top face or bottom face of the cylindrical body. A ring may be coupled to a pipe such that the ring is capable of tightening against a top face or bottom face of a cylindrical body that is coupled to the pipe. A pipe may be capable of coupling to a downhole component, e.g., a drilling string, by engaging a threaded end portion of the pipe with a threaded end portion of the downhole component.

The term "cylindrical body" as used herein is defined as an object having at least one or more cylindrical inner or surfaces. A cylindrical body may be shaped like a hollow tube that is capable of permitting fluids or objects to pass through the pipe, e.g., production fluid. A cylindrical body may have one or more portions that have a radius that is different from the rest of the cylindrical body, e.g., a center solid portion of a cylindrical body may be "thinner" than the rest of the cylindrical body. A cylindrical body may be sized to fit within a cylindrical housing, yet be capable of axial movement within the cylindrical housing. A cylindrical body that has an outer diameter that changes abruptly may have a radial face or "lip" (see, e.g., 25, FIG. 2) on the outer surface of the cylindrical body on which an axial force may be applied, for example, by a spring. A cylindrical body may have a channel (port) that passes radially through the side wall of the cylindrical body, connecting the inner bore of the cylindrical body to the exterior environment outside the cylindrical body. A cylindrical body may include a nose on one end of the cylindrical body. The other end of the cylindrical body may be open such that fluid may flow into the production tubing from the cylindrical body. Fluid may be capable of passing through the cylindrical body by entering the radial channel and exiting out the open end of the cylindrical body. Fluid may be capable of passing through the cylindrical body by entering the open end of the cylindrical body and exiting out the radial channel through the side wall of the cylindrical body. Fluid may be capable of passing through the cylindrical body by entering a nose opening (see, e.g., 40, FIG. 2) and exiting out the open end of the cylindrical body.

The term "seal" as used herein as a noun is defined as a substantially water-tight interface between two surfaces, e.g., such that water is substantially incapable of passing between the surfaces under anticipated conditions. A seal exists between two contacting surfaces when less than 1 milliliter of fluid, preferably none, and is capable of coming into contact with either of the surfaces at pressures of 14.7 psig for 1 hour. The term "sealing" as used herein as an adjective is defined as capable of or used in forming a seal. A sealing face of an object may be the face of that object that is used to form a seal with a second object such that the sealing face forms a water-tight contact with the second object. A seal may be formed when a sealing face contacts another surface of the same object or another object.

The term "threaded" as used herein is defined as having threads. Threads may include one or more helical protrusions or grooves on a surface of a cylindrical object. Each full rotation of a protrusion or groove around a threaded surface of the object is referred to herein as a single "thread." The number of threads per longitudinal inch of a threaded portion of a pipe may range from a low of 2, 3, 4, 5, 6, or 8 threads per longitudinal inch to a high of 4, 5, 6, 8, 10, 12, or 15 threads per longitudinal inch. A pipe may include a "threaded portion" wherein a section of the pipe includes threads on an outer surface or an inner surface of the pipe. A pipe may include more than one threaded portion. For example, a pipe may include two outer surface sections having threads with a non-threaded outer surface section positioned between them. For example, a pipe may include two outer surface sections adjacent to one another, wherein the two sections have different thread densities (number of threads per inch). For example, a pipe may include one or more outer surface sections having threads and a portion of an inner surface of the pipe may have threads. A threaded portion of a pipe may include an axial slot running substantially perpendicularly to the threads such that the threads may be broken at the slot, yet are still capable of engaging another threaded surface. A non-threaded portion of a pipe may include a section of the pipe without threads, e.g., a smooth portion of a pipe surface. A cylindrical object may include a "threaded portion" wherein a section of the cylindrical object includes threads on an outer surface or an inner surface of the cylindrical object. An anti-rotation threaded connection includes a component capable of moving axially with respect to the cylindrical object that does not rotate with respect to the threads and prevents one or more threaded objects from rotating. One example of an anti-rotation threaded connection is the Piranha Lock™.

The term "cavity" as used herein is defined as any hollow space within an object or on an object's surface. A cavity may be defined by one or more surfaces which form the inner walls of the cavity. For example, a hollow sphere may encase a cavity, and the curved inner surface of the sphere may define the cavity. For example, a hollow cylinder may encase a cavity which would be defined by the inner surface of the two circular faces and the inner surface of the curved side wall. A cavity may have a fluid connection to a conduit connected to the cavity. A cavity may refer to the volume defined by a number of surfaces plus the volume of the inside of the conduit, but preferably a cavity refers to the volume defined by the number of surfaces and excludes the volume within the conduit, i.e., the cavity is defined in part by area where the fluid connection is made. A cavity may be filled with hydraulic fluid. A cavity may be capable of holding fluid under pressure (the cavity may maintain its structural integrity when hydraulic pressure is applied to the walls forming the cavity through the fluid the cavity is holding). A cavity may be capable of expanding in volume when the hydraulic fluid pressure against the walls forming the cavity is increased. For example, one wall defining the cavity may be moveable with respect to the remaining walls defining the cavity such that when the wall moves, the cavity increases or decreases in size. Hydraulic pressure may cause the moveable wall to shift.

The term "press" as used herein as a verb is defined as apply force or pressure. An object that presses against another object may apply a directional force on that object. A pressing force does not need to be unidirectional or involve direct physical contact between one object and another object that is pressed. In some specific embodiments, an object may be sandwiched between two other objects, such that pressing upon one of the outer objects causes the middle object to press upon the other outer object. A pipe may press against a side wall opening of a ring and expand the opening of the ring to a width through which the pipe is capable of passing. For example, an outer surface of a pipe of diameter X may press against a ring comprising a side wall opening having a width that is less than X and cause the opening to expand until the opening width is greater than or equal to X. When a cylindrical body is positioned in a wellbore as part of a blowout preventer stack, a pipe ram comprising a pipe ram inner surface may be capable of pressing against an outer surface of the cylindrical body to seal an upper portion of the wellbore that is above the cylindrical body from a lower portion of the wellbore that is below the cylindrical body. A flat, circumferential face of a ring having an inner threaded surface that is coupled to (e.g., screwed onto) a pipe positioned within a seal bore of a cylindrical body may be capable of pressing against a top face or bottom face of the cylindrical body. For example, a pipe having two threaded portions may be positioned within a seal bore of a cylindrical body such that one threaded portion is exposed on the top portion of the pipe and the other threaded portion is exposed on the bottom portion of the pipe; then a first threaded ring may be screwed onto one threaded portion of the pipe until it is adjacent to a top face of the cylindrical body and a second threaded ring may be screwed onto the other threaded portion of the pipe until it is tightened against a bottom face of the cylindrical body, thereby securing the cylindrical body at a specific axial position on the pipe. For example, referring to the previous example, a third ring comprising a first circumferential face having teeth and a second flat circumferential face may be positioned between the second ring and the bottom face of the cylindrical body such that when the second ring is screwed on the pipe towards the cylindrical body, the second ring presses against the flat circumferential face of the third ring, and the circumferential face having teeth of the third ring presses against the bottom face of the cylindrical body. For example, referring to the previous example, a fourth ring comprising a circumferential face having teeth may be coupled to the bottom face of the cylindrical body such that the circumferential face having teeth of the fourth ring faces away from the bottom face of the cylindrical body, in which case the circumferential face having teeth of the third ring presses against the circumferential face having teeth of the fourth ring.

The term "pressure" as used herein is defined as force applied to, on, or against anything, e.g., an object. A fluid may exert pressure against a surface $A_2$ of an object, for example, when a force $F_1$ is applied to another area $A_1$ of the fluid. Force applied to area $A_1$ is transferred to the surface A2 of the object through incompressible liquid according to Pascal's law. That is, the force $F_2$ on the surface $A_2$ is equal to: the force $F_1$ applied to area $A_1$ of the fluid, divided by the area $A_1$ of the fluid, and times the size of surface $A_2$ of the object, or:

$$F_2=(F_1/A_1)\times A_2$$

Hydraulic pressure may be used to compress a spring. For example, hydraulic pressure against a surface of an object which is contacting one end of a spring may be transferred as force through the object. Hydraulic pressure may compress the spring if the hydraulic pressure produces a force that is greater than the existing spring force. Spring force is determined using the spring's constant and the distance the spring is compressed. The spring force may vary depending on a number of factors including, but not limited to, the length of the spring, the diameter of the spring wire, and the material of the spring wire.

The term "nose" as used herein is defined as a projecting end of an object. One end of a cylindrical body may be a nose. A nose of a cylindrical body is preferably cone-shaped. A nose may include a solid cone metal on a cylindrical body. A nose may be mushroom-shaped, i.e., having a cylindrical shaft coupled to a cone-shaped portion. A nose may include one or more nose openings. Nose openings may be present on a cylindrical portion of a nose rather than the cone-shaped portion of the nose. For example, nose openings may extend radially through the cylindrical portion of the nose to connect an inner channel of a cylindrical body to an area external to the cylindrical body. A nose may be shaped to form a seal with a sealing face of a floating seat when in contact with the sealing face.

The term "housing" as used herein is defined as a structure comprising at least one inner cavity. A cylindrical housing may have a cylindrically-shaped portion. A cylindrical housing may include a channel, which may be an inner cavity. A housing may include a center housing, a top sub, and a bottom sub. A housing may be capable of containing an object, e.g., a cylindrical body. A cylindrical housing may contain a cylindrical body such that the center axis of the cylindrical body is the center axis of the cylindrical housing. A cylindrical housing may be fixed with respect to production tubing. A housing may be capable of containing more than one object. An object within a housing may be capable of moving axially with respect to the housing.

The term "channel" as used herein is defined as a passage that has an opening at either or both end(s). A channel may refer to a passage extending through one side wall of a cylindrical housing (extends from outside the cylindrical housing to inside the cylindrical housing). A channel may refer to a passage extending through the side wall of a cylindrical housing two times (extends from outside one side the cylindrical housing to the outside of another side). A channel may intersect with another channel, e.g., an axial channel may pass through a radial channel. A cylindrical housing may refer to a cylindrical object having a channel running axially through the cylindrical object. A cylindrical body may also have a channel running axially through the cylindrical body. A channel on a first object may at least partially align with a channel on a second object such that fluid can pass through both channels and, therefore, both objects. Furthermore, a channel in a cylindrical body may include a tubular passage beginning at a top face of the cylindrical body and ending at a bottom face of the cylindrical body. A channel may be sized to receive a receptacle containing an electrical cable, e.g., a motor lead extension (MLE). A channel may include a channel wall (surface) which may be capable of forming a seal with an outer surface of a receptacle containing an electrical cable, e.g., an electrical penetrator. A channel may run substantially parallel to a central axis of a cylindrical body. A channel may be positioned such that it is off-center from a center axis of a cylindrical body, whereas a seal bore may be positioned such that it is centered on the center axis of the cylindrical body. A channel may be substantially parallel to a seal bore such that the channel wall is less than 1, 2, 3, 4, 5, 10, or 15 degrees from parallel to the seal bore (or to a center axis of a cylindrical body).

The term "connect" as used herein is defined as put in fluid communication with.

The term "align" as used herein is defined as connect by moving a structure with respect to another structure. Fluid may be capable of passing through a first channel and a second channel if the first channel is/has been aligned with the second channel. A first channel in an object is not aligned with a second channel in a second object if the first channel is adjacent to a surface of the second object rather than adjacent to the second channel.

The term "positioned" as used herein is defined as existing; formed; or present. An object may be positioned within a housing if the object exists adjacent a side wall of the housing. A channel may be positioned radially through a cylindrical object if the channel runs perpendicularly to the center axis of the cylindrical object. A channel may be positioned axially through a cylindrical object if the channel runs parallel to the center axis of the cylindrical object.

The term "side wall" as used herein is defined as the side of something. A side wall may be a structure that forms the side of something. A side wall may be a face of a structure that forms the side of something. When referring to a side wall of a cylindrical object, the side wall may include the curved face that forms the side of a cylinder (rather than any flat, circular faces that may form the end of a cylinder). As used herein, a side wall of a hollow cylinder may refer to the entire wall forming the tubular portion of the cylinder (360 degrees), or a portion of that wall (e.g., half of the wall that forms 180 degrees of the cylinder). A channel positioned radially through a side wall may pass entirely through the side wall (the channel length may be greater than the radius of the cylinder, e.g., the channel length may be the diameter of the cylinder). A channel positioned radially through a side wall of a hollow cylinder may connect the outside of a cylinder to the inside of the cylinder (the channel length may be less than or equal to the radius of the cylinder). A side wall may refer to an outer, curved surface of a cylindrical body. A side wall may refer to an inner, curved surface of a cylindrical body.

The term "defined by" as used herein means as bordered by; outlined by; or formed from. A cavity that is defined by a first face and a second face has a cavity volume that is determined at least in part by the spatial relationship (e.g., distance, angle) between the first face and the second face. A cavity may be defined by a single face. A cavity defined by one or more faces may be completely enclosed (bound on all sides by a face). A cavity is preferably partially enclosed. For example, a cavity may be connected to a conduit, in which case the cavity is not completely enclosed because the connection to the conduit removes a part of the face that otherwise defines the cavity. A cavity is preferably defined by more than one face. A cavity may be defined by a flat, radial face of a cylindrical body (and thus have a flat radial face). A cavity may be defined by an outer side wall of a cylindrical body (and thus have an inner side wall formed by the outer side wall).

The term "spring" as used herein is defined as an object capable of storing mechanical energy. A spring may have coiled, helical, or cylindrical shape. A spring may include steel, e.g., spring steel. A spring may have elastic qualities that permit the spring to stretch or compress when a force is applied, then return to its original shape when the force is removed. A spring may be positioned between two objects such that the spring goes from a more compressed state to a less compressed state as the objects move with respect to one another. A compressed spring may exert a force on a face of an object that is causing the spring to compress. For example, a helical spring positioned within a cylindrical housing may exert a force axially against a radial face (e.g., a radial lip extending toward the center axis) of the cylindrical housing. For example, a helical spring positioned outside and around a cylindrical body may exert a force axially against a radial face (e.g., a radial lip extending outward from center axis) of the cylindrical body. A spring positioned within a cylindrical housing and around a cylindrical body may exert a force on both the cylindrical housing and the cylindrical body.

The term "conduit" as used herein is defined as a tubular structure, preferably one through which fluid is stored and/or conveyed. A conduit may be coupled to a cavity (i.e., the conduit may be in fluid connection with the cavity). A conduit may extend from near the bottom of a wellbore to the surface of the well. A conduit may be coupled to a fluid tank. A conduit may include a polymer. A conduit may be constructed to store fluid with a variety of possible hydraulic pressures ranging from a low of 0 psig, or 10 psig, or 500 psig to a high of 2,000 psig, or 5,000 psig, or 7,500 psig or 10,000 psig, or 15,000 psig, or 20,000 psig, or 30,000 psig. A conduit may be capable of transferring hydraulic pressure through hydraulic fluid downhole to the cavity, thereby increasing the fluid pressure against the walls of the cavity and increasing the volume of the cavity itself.

The term "ring" as used herein is defined as a ring-shaped structure. A ring may have a circular shape. A ring may be a partial ring having an opening in a side wall. A partial ring may have an arc shape such that the inner face of the arc measures from a low of 180, 200, or 225 degrees to a high of 240, 255, 270, or 295 degrees. A ring may include two circumferential faces which may be flat, have teeth, or one may be flat and one may have teeth. A ring may exist as a separate object or may be coupled to another object, e.g., either permanently or removably coupled to a top face or bottom face of a cylindrical body, e.g., a pipe. A ring may be capable of being coupled to a pipe, e.g., by threading the ring onto a threaded portion of the pipe or by positioning a non-threaded ring on a pipe such that the inner surface of the ring contacts the outer surface of the pipe. A ring may have a height that is less than the ring diameter. The height of the ring may be the distance between the two circumferential faces at either end of the ring. A ring may have a threaded hole through its side wall through which a bolt may be screwed. A ring may have a threaded inner surface or a non-threaded inner surface. A ring may have one or more protrusions extending radially inward from its inner surface. Threads on an inner surface of a ring may be capable of engaging threads on an outer surface of a pipe.

The term "seal bore" as used herein is defined as an elongated passage through an object whose wall is capable of being sealed with another object, i.e., capable of contacting another object in a manner that causes a seal to exist. A seal bore may be cylindrical in shape. A seal bore in a cylindrical body may form a passage beginning at a top face of the cylindrical body and ending at a bottom face of the cylindrical body. A seal bore may be sized to receive a pipe as part of a blowout preventer can assembly. A seal bore may be surface finished. A seal bore may be a polished receptacle for a standing valve or plug.

The term "teeth" as used herein is defined as two or more projections from an object. Each of the teeth is referred to herein as a "tooth." Each of the teeth may be substantially similar to one another in shape and size. Teeth may form a circumferential face of an object, and the number of teeth around the circumferential face may range from a low of 0.25, 0.5, 0.75, 1.0, 1.25, 1.5, 2.0, 2.5, or 3.0 teeth per circumferential inch to a high of 2.0, 2.25, 2.5, 3.0, 3.5, 4.0, 5.0, 6.0, 7.0, or 8.0 teeth per circumferential inch. A tooth may include a point, two sides, and a base, wherein the height of the tooth is the distance between the tooth base and the tooth point. The sides of the teeth of a first object may be capable of contacting the sides of the teeth of another object.

The term "pointed" as used herein is defined as having a particular direction. A tooth may be pointed toward an object when the point of the tooth is closer to the object than the base of the tooth. A tooth may be pointed toward an object when an imaginary line drawn perpendicularly from the base of the tooth through the point of the tooth intersects that object. A tooth on a circumferential face may be pointed in an axial direction when an imaginary line drawn perpendicularly from the base of the tooth through the point of the tooth is substantially parallel (i.e., less than 1, 2, 3, 4, 5, 10, or 15 degrees skewed from parallel) to a center axis of the circumferential face.

The term "pipe" as used herein is defined as an object having at least one cylindrical end portion. In the disclosure, at least one type of pipe is a "mandrel." A pipe may be shaped like a hollow tube that is capable of permitting fluids or objects to pass through the pipe, e.g., a joint of drill pipe or production tubing. A pipe may include an object (e.g., blowout preventer can) having a cylindrical end portion capable of coupling that object to another object, e.g., a threaded ring. A pipe may include one or more threaded portions. A pipe may be capable of coupling to a drilling string, e.g., via a threaded connection, and the drilling string may include multiple pipes connected together. A pipe may include a threaded portion on the end of the pipe. For example, a pipe may have a threaded portion on one end section of the pipe such that an outer surface of the end section of the pipe is threaded. For example, a hollow pipe may have a threaded portion on one end section of the pipe such that an inner surface of the end section of the pipe is threaded. A pipe may include a threaded portion on a central section of the pipe. For example, a pipe may have one or more portions of the outer surface of the pipe that are threaded, and the threaded portions may be separated by a non-threaded portion. A pipe may have a non-threaded central section. A pipe may be positioned within a seal bore of a blowout preventer can such that a non-threaded, central section is adjacent to a seal bore surface. A pipe may include an elongated, axial slot on an outer surface of the pipe. A pipe may include one or more circumferential faces having teeth on one or both ends of the pipe.

The term "limited" as used herein is defined as reduced or eliminated. For example, the ability of a cylindrical body in a limited state to move axially or radially may be reduced if the force required to move the cylindrical body has doubled when compared to the force required to move the cylindrical body in an unlimited state. The ability of a cylindrical body to move axially or radially when coupled to a pipe may be limited when two or more rings press against a top face and a bottom face of the cylindrical body. Movement of a cylindrical body coupled to a first ring comprising a circumferential face having teeth may be limited with respect to a second ring when the second ring comprising a circumferential face having teeth presses against the first ring, causing the teeth of the first ring to engage the teeth of the second ring. One or more rings coupled to a pipe may limit the ability of a cylindrical body coupled to the pipe to rotate with respect to the pipe.

The term "fix" as used herein is defined as secure or fasten. A cylindrical body coupled to a pipe positioned in a seal bore of the cylindrical body may be fixed with respect to the pipe if the cylindrical body cannot move axially along the pipe or rotate about the pipe. A cylindrical body may be fixed on a pipe at a specific radial and axial location for placement of the cylindrical body into a wellbore.

The term "circumferential face" as used herein is defined as the circular face of one end of a cylindrical object. A ring may include two circumferential faces, each of which has a concentric, circular cavity forming a passage through the ring. A solid pipe may have two circumferential faces that are circular in shape. A hollow pipe may have two circumferential faces that are circular in shape with a concentric, circular cavity. A circumferential face may be flat (entirely perpendicular to a side wall of a cylinder). A circumferential face of a ring or hollow pipe may have teeth.

The term "slot" as used herein is defined as an opening or groove of any shape or dimension, preferably one that is rectangular with two parallel sides over 5-10 times longer than its two parallel ends. A slot may include an opening that passes entirely through a wall of an object, e.g., from an outer surface to an inner surface. Alternatively, a slot in a surface of an object may be a groove that has a bottom. A pipe may include two elongated, axial slots (elongated in an axial direction) on separate sections of the pipe that are separated axially from each other by a central, non-slotted pipe section. A slot may have a depth that corresponds to the height of a protrusion on an inner surface of a ring. A pipe may be capable of coupling with a ring when a protrusion on an inner surface of the ring engages with an axial slot on an outer surface of the pipe such that the ring is incapable of rotating with respect to the pipe, yet the ring is capable of moving axially along the outer surface of the pipe.

The term "engage" as used herein is defined as make physical contact. A first object that engages a second object may be capable of influencing the movement of the second object. For example, rotating a first object that engages a second object may cause the second object to rotate in the same direction as the first object. A first pipe comprising a circumferential face having teeth may engage a second pipe comprising a circumferential face having teeth. Teeth of a first pipe may engage teeth of a second pipe when the sides of the teeth of the first pipe contact the sides of the teeth of the second pipe. Teeth of a first pipe may engage teeth of a second pipe (or ring) when the points of the teeth of the first pipe are axially in-line with the base of the teeth of the second pipe (or ring) such that rotation of the first pipe causes rotation of the second pipe (or ring). An object having threads may be capable of engaging another object having threads such that axial movement of the first object causes axial movement of the second object. For example, a first pipe having a threaded outer surface may be capable of engaging a second pipe having a threaded inner surface when at least some of the threads of the first pipe are screwed with at least some of the threads of the second pipe. For example, a ring having a threaded inner surface may be capable of engaging a pipe having a threaded outer surface when at least some of the threads of the ring are screwed with at least some of the threads of the pipe. An object having threads that overlap with another object may be engaged with that object.

3. Certain Specific Embodiments

Now, certain specific embodiments are described, which are by no means an exclusive description of the inventions. Other specific embodiments, including those referenced in the drawings, are encompassed by this application and any patent that issues therefrom.

The disclosure herein includes systems and methods for pressure testing of production tubing in an oil or gas well. These systems and methods comprise, or otherwise utilize, a valve capable of being coupled to an electrical submersible pump (ESP) and the production tubing downhole in the oil or gas well, wherein the valve includes: a first cylindrical body having a nose and a first channel positioned axially through the first cylindrical body and a second channel positioned radially through the first cylindrical body such that the second channel connects to the first channel; a cylindrical housing having a third channel positioned radially through the cylindrical housing that is capable of aligning with the second channel, wherein the first cylindrical body is positioned within and capable of moving axially within the cylindrical housing; and a second cylindrical body having a fourth channel positioned axially through the second cylindrical body and a radial sealing face capable of contacting the nose of the first cylindrical body to form a seal, wherein the second cylindrical body is positioned within and capable of moving axially within the cylindrical housing.

In any one of the methods, structures, elements or parts disclosed herein, the valve may further include a spring positioned within the cylindrical housing.

In any of the methods, structures, elements or parts disclosed herein, the spring may press on a radial face of the first cylindrical body and a radial face of the cylindrical housing; and the nose of the first cylindrical body may press on the radial sealing face of the second cylindrical body.

Any one of the methods, structures, elements or parts disclosed herein may involve powering on the ESP.

Any one of the methods, structures, elements or parts disclosed herein may involve applying fluid pressure to the nose of the first cylindrical body, thereby lifting the nose from the radial sealing face of the second cylindrical body and creating a fluid connection between the ESP and the production tubing through the second channel which may be at least partially aligned with the third channel.

The disclosure herein includes further embodiments of systems and methods for pressure testing of production tubing in an oil or gas well. Such embodiments similarly comprise, or otherwise utilize, a valve capable of being coupled to an electrical submersible pump (ESP) and the production tubing downhole in the oil or gas well, wherein the valve may include: a cylindrical housing having a first side wall and a bottom face, wherein a first channel may be positioned radially through the first side wall; a first cylindrical body having a second side wall, wherein a second channel may be positioned radially through the second side wall; a second cylindrical body having a third side wall, a first radial face, and a second radial face; and a cavity that may be defined by the first radial face, the first side wall, and the bottom face.

In even further embodiments, the valve may include: a cylindrical housing having a first side wall and a bottom face, wherein a first channel may be positioned radially through the first side wall; a cylindrical body having a second side wall, a first radial face, and a second radial face, wherein a second channel may be positioned radially through the second side wall; a cavity that may be defined by the first radial face of the cylindrical body, the first side wall, and the bottom face.

In any one of the methods, structures, elements or parts disclosed herein, the cavity may contain fluid.

Any one of the methods, structures, elements or parts disclosed herein may involve increasing the fluid pressure against the cavity and increasing the volume of the cavity.

Any one of the methods, structures, elements or parts disclosed herein may involve increasing the size of the cavity to cause a second channel, if present, to not be aligned with the first channel, if present, thereby closing a fluid connection between the production tubing and an annulus.

In any one of the methods, structures, elements or parts disclosed herein, the valve further may include a conduit having a fluid connection with the cavity.

In any one of the methods, structures, elements or parts disclosed herein, fluid pressure against the cavity may be increased through fluid in the conduit.

In any one of the methods, structures, elements or parts disclosed herein, the increase in fluid pressure in the cavity may be sufficient to overcome a force applied by a spring on a radial face of the first cylindrical body.

In any one of the methods, structures, elements or parts disclosed herein, the cylindrical housing may include a center housing, a top sub, and a bottom sub.

In any one of the methods, structures, elements or parts disclosed herein, the top sub/bottom sub may be coupled to the center housing using an anti-rotation threaded connection.

The disclosure herein includes a blowout preventer can assembly for an oil or gas well including a blowout preventer can having a top face and a bottom face, a seal bore extending axially through the center of the blowout preventer can from the top face to the bottom face, a channel extending axially from the top face to the bottom face, and a first ring coupled to the top face or the bottom face of the blowout preventer can, wherein the first ring includes a circumferential face including teeth pointed axially away from the blowout preventer can.

The disclosure herein includes a blowout preventer can assembly for an oil or gas well including a pipe having an outer surface and an inner surface, wherein the pipe is capable of coupling to at least one downhole component in a wellbore, and a cylindrical body comprising a top face, a bottom face, a seal bore comprising a seal bore surface that connects the top face and the bottom face, and a channel that connects the top face and the bottom face. The channel of the cylindrical body is capable of containing a receptacle containing an electrical cable, the pipe is capable of being positioned within the seal bore such that a seal exists between the outer surface of the pipe and the seal bore surface, and an ability of the cylindrical body to move axially and radially with respect to the pipe is capable of being limited when the pipe is positioned within the seal bore.

The disclosure herein includes a blowout preventer can assembly for an oil or gas well, including a pipe having an outer surface, wherein the pipe is capable of coupling to at least one downhole component in a wellbore, a cylindrical body having a top face, a bottom face, an outer surface, and a seal bore having a seal bore surface that connects the top face and the bottom face, and a pipe ram including a pipe ram inner surface. The cylindrical body is capable of containing at least a portion of an electrical penetrator, the pipe is capable of being positioned within the seal bore such that a seal exists between the outer surface of the pipe and the seal bore surface, the cylindrical body is capable of being fixed at a specific radial and axial position relative to the pipe when the pipe is positioned within the seal bore, and the pipe ram is capable of pressing against the outer surface of the cylindrical body such that a seal exists between the outer surface of the cylindrical body and the pipe ram inner surface.

The disclosure herein includes a blowout preventer can assembly for an oil or gas well comprising a pipe comprising a central section, wherein the pipe is capable of coupling to at least one downhole component in a wellbore, a cylindrical body comprising a top face, a bottom face, and a seal bore comprising a seal bore surface that connects the top face and the bottom face, a receptacle containing an electrical cable, and two or more rings, each comprising an inner surface and at least one circumferential face. The cylindrical body is capable of containing at least a portion of the receptacle, the pipe is positioned within the seal bore such that a seal exists between the central section of the pipe and the seal bore surface, and at least one ring is capable of being coupled to the pipe such that the circumferential face of the ring is adjacent to and pressing against the top face or the bottom face of the cylindrical body, thereby fixing the cylindrical body at a specific radial and axial position with respect to the pipe.

In any one of the specific versions disclosed herein, the system may include two or more rings, each including an inner surface, wherein each ring is coupled to the pipe, at least one of the rings is adjacent to and pressing against the top face of the cylindrical body, and at least one of the rings is adjacent to and pressing against the bottom face of the cylindrical body, thereby causing the ability of the cylindrical body to move axially and radially with respect to the pipe to be limited when the pipe is positioned within the seal bore.

In any one of the specific versions disclosed herein, the system may include two or more rings, each including an inner surface, wherein each ring is capable of being coupled to the pipe, at least one of the rings includes a circumferential face including teeth pointed in an axial direction, and at least one ring is capable of causing the ability of the cylindrical body to move axially and radially with respect to the pipe to be limited when the circumferential face of the ring is adjacent to and pressing against the top face or the bottom face of the cylindrical body.

In any one of the specific versions disclosed herein, at least one of the rings may be coupled to the top face, the bottom face, or to each of the top face and bottom face of the cylindrical body.

In any one of the specific versions disclosed herein, at least one of the rings comprising the circumferential face including teeth may further include at least one protrusion on the inner surface of the ring.

In any one of the specific versions disclosed herein, the pipe may include at least one elongated, axial slot on the outer surface of the pipe, and the slot may be capable of receiving the protrusion on the inner surface of the ring.

In any one of the specific versions disclosed herein, the ring may be capable of being moved axially along the outer surface of the pipe, and the ring may be incapable of rotating on the pipe when the protrusion of the ring engages the slot of the pipe.

In any one of the specific versions disclosed herein, at least two of the rings each may include a circumferential face including teeth pointed in an axial direction, at least one ring comprising the circumferential face including teeth may be coupled to the top face or the bottom face of the cylindrical body, at least one ring comprising the circumferential face including teeth further may include at least one protrusion on the inner surface of the ring, and the pipe may include at least one elongated, axial slot on the outer surface of the pipe, wherein the slot is capable of receiving the protrusion on the inner surface of the ring.

In any one of the specific versions disclosed herein, the system may include a first ring comprising a circumferential face including teeth pointed in an axial direction, wherein the first ring is coupled to the top face or the bottom face of the cylindrical body, and a second ring comprising a circumferential face including teeth pointed in said axial direction and at least one protrusion on an inner surface of the second ring, wherein the pipe may include at least one elongated, axial slot on the outer surface of the pipe, the slot may be capable of receiving the protrusion on the inner surface of the second ring, thereby coupling the second ring to the pipe, and the circumferential face including teeth of the second ring may be capable of engaging the circumferential face including teeth of the first ring such that the ability of the cylindrical body to move axially and radially with respect to the pipe is limited when the pipe is positioned within the seal bore.

In any one of the specific versions disclosed herein, the system may include a first ring comprising a circumferential face including teeth pointed in an axial direction, wherein the first ring is coupled to the bottom face of the cylindrical body, a second ring comprising a circumferential face including teeth pointed in said axial direction, a flat circumferential face, and at least one protrusion on an inner surface of the second ring, and a third ring comprising a threaded inner surface and a flat circumferential face, wherein the pipe may include at least one elongated, axial slot on the outer surface of the pipe, the outer surface of the pipe may include a first threaded portion and a second threaded portion, the slot may be capable of receiving the protrusion on the inner surface of the second ring, thereby coupling the second ring to the pipe, and the circumferential face including teeth of the second ring may be capable of engaging the circumferential face including teeth of the first ring such that the ability of the cylindrical body to move axially and radially with respect to the pipe is limited when the second ring is coupled to the pipe, the pipe is positioned within the seal bore, the threaded inner surface of the third ring engages the first threaded portion of the pipe, and the circumferential face of the third ring is immediately adjacent to the top face of the cylindrical body.

In any one of the specific versions disclosed herein, the system may include a fourth ring including a threaded inner surface and a flat circumferential face, wherein the threaded inner surface of the fourth ring may be capable of engaging the second threaded portion of the pipe, and the flat circumferential face of the fourth ring may be capable of positioned immediately adjacent to the flat circumferential face of the second ring.

In any one of the specific versions disclosed herein, the system may include a receptacle containing an electrical cable, wherein the electrical cable may be capable of coupling to an electrical circuit of an electrical submersible pump.

In any one of the specific versions disclosed herein, the system may include a blowout preventer assembly comprising a pipe ram including a pipe ram inner surface, wherein the pipe ram may be capable of pressing against the outer surface of the cylindrical body such that a seal exists between the outer surface of the cylindrical body and the pipe ram inner surface.

In any one of the specific versions disclosed herein, the system may include a first ring including a threaded inner surface and flat circumferential face and a second ring including a threaded inner surface and flat circumferential face, wherein the first ring may be capable of being coupled to a first threaded portion of the pipe such that the flat circumferential face of the first ring is positioned immediately adjacent to the top face of the cylindrical body, and the second ring may be capable of being coupled to a second threaded portion of the pipe such that the flat circumferential face of the second ring is positioned immediately adjacent to the bottom face of the cylindrical body, thereby causing the axial movement of the cylindrical body to be limited with respect to the pipe.

In any one of the specific versions disclosed herein, the channel is substantially parallel with the seal bore.

In any one of the specific versions disclosed herein, the teeth of at least one of the rings have a height between 0.25 cm and 4.0 cm.

In any one of the specific versions disclosed herein, the pipe is located in a wellbore.

4. Specific Embodiments in the Figures

The drawings presented herein are for illustrative purposes only and are not intended to limit the scope of the claims. Rather, the drawings are intended to help enable one having ordinary skill in the art to make and use the claimed inventions.

Referring now to FIG. 1, an ESP 20 may be positioned downhole with a hydraulic bypass valve 10 positioned above the ESP 20 and coupled to production tubing 19. When fluid is produced from a formation, the ESP 20 may be positioned near the bottom of the well and in fluid connection with production tubing 19. A hydraulic bypass valve 10 may be positioned just above the ESP 20. The hydraulic bypass valve 10 may provide a fluid connection from the production tubing line to the annulus through an opening 26 when needed, both when fluid flows upward as well as downward. The upper portion of the ESP 20 may be coupled to the production tubing using a flange connection 21. The hydraulic bypass valve 10 may be coupled indirectly to the ESP 20 by a length of production tubing 19 that is positioned between and coupled to the ESP 20 and the hydraulic bypass valve 10. The length of production tubing 19 may vary, but is preferably between 6 and 10 feet in length. The production tubing 19 separating the ESP 20 and the hydraulic bypass valve 10 may have both a threaded connection to couple to the bottom sub (74, FIG. 6B) of the hydraulic bypass valve 10 and a flange connection end to couple to the flange adapter 21 of the ESP 20. Alternatively, the hydraulic bypass valve 10 may be coupled directly (not depicted) to the ESP 20 using a threaded connection or a flange connection through the bottom sub.

Figure 2:
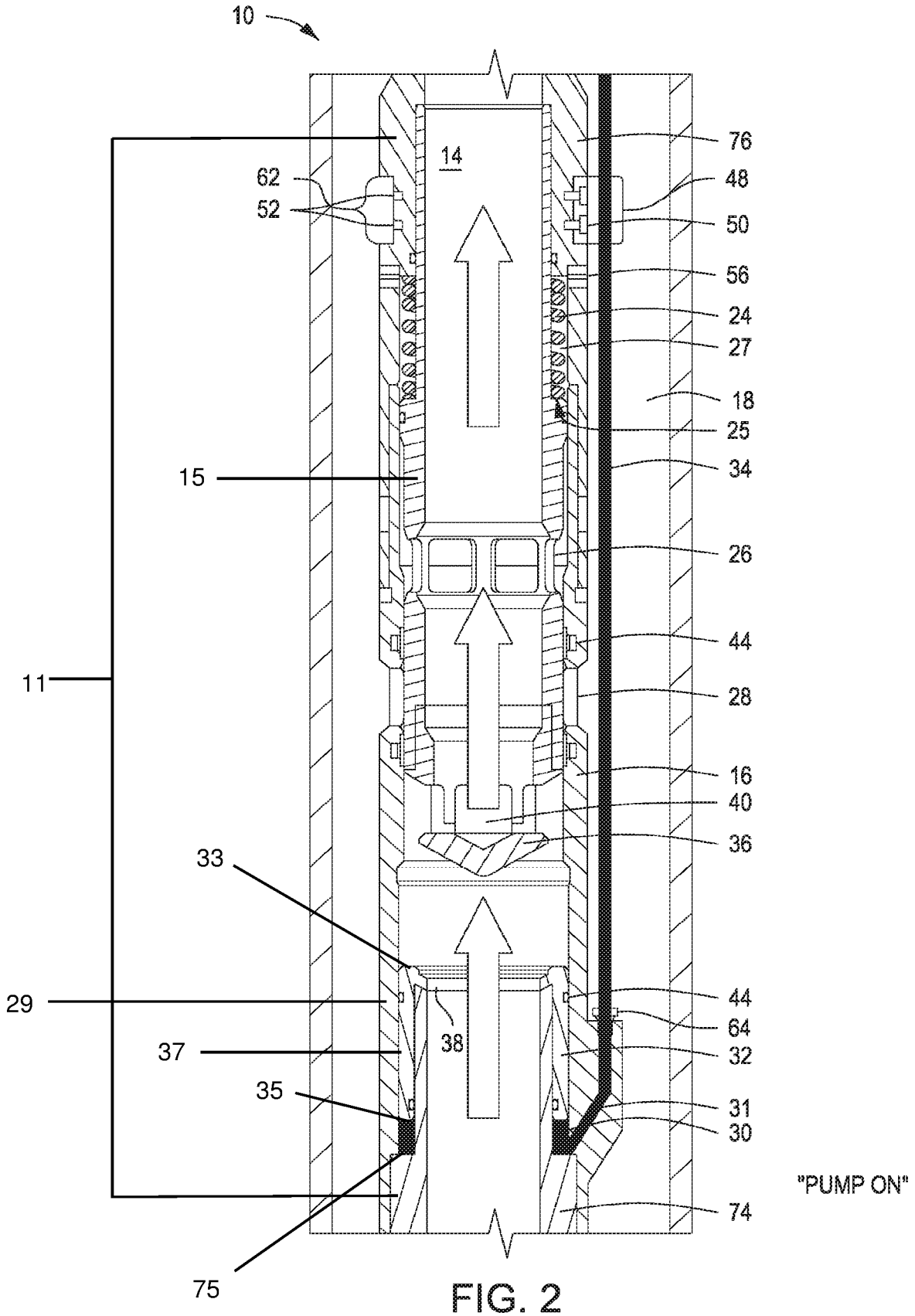
FIG. 2 is a simplified, cutaway view of a structure that includes a hydraulic bypass valve where an ESP is running.
Figure 3:
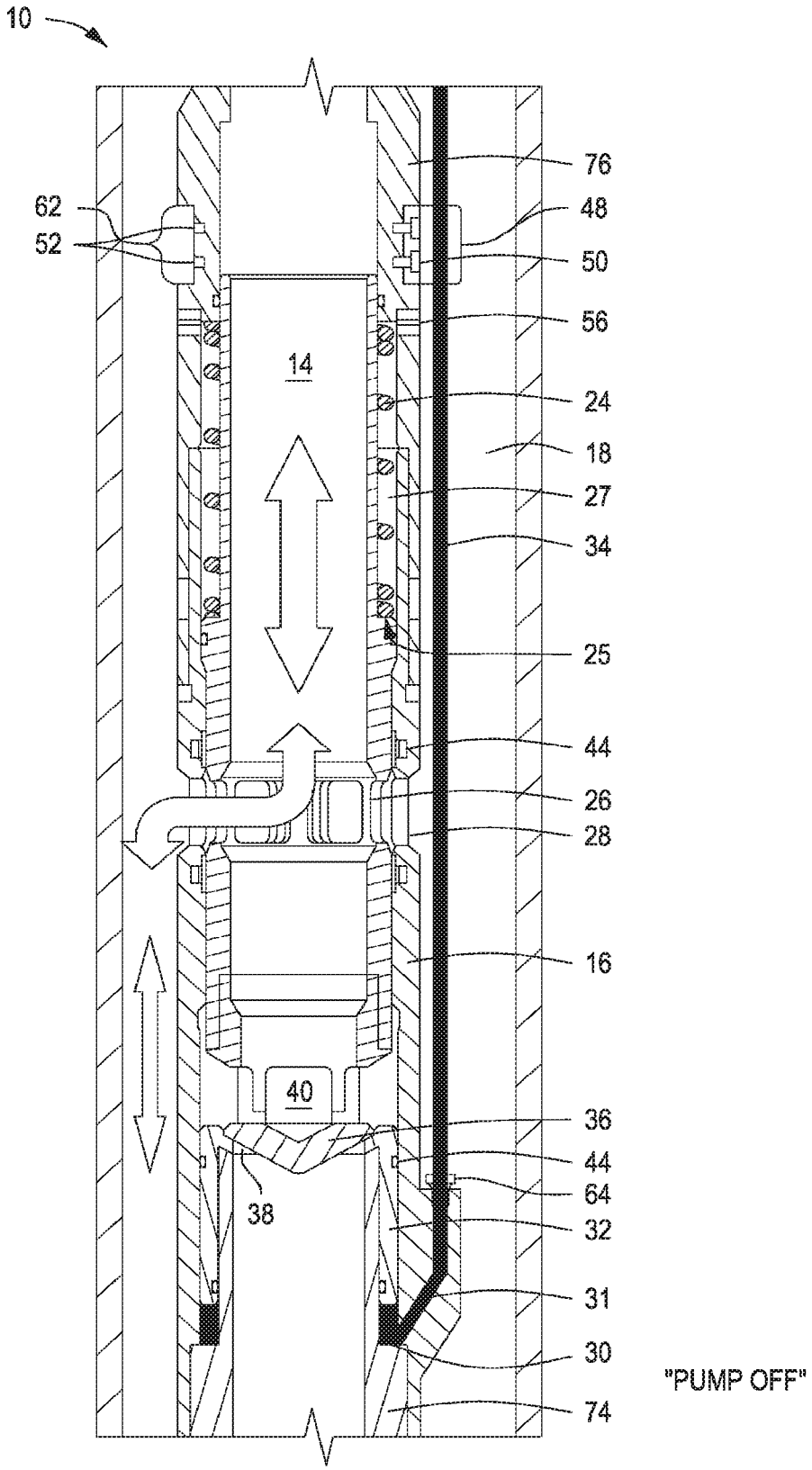
FIG. 3 is a simplified, cutaway view of a structure that includes a hydraulic bypass valve where an ESP is not running.
Figure 4:
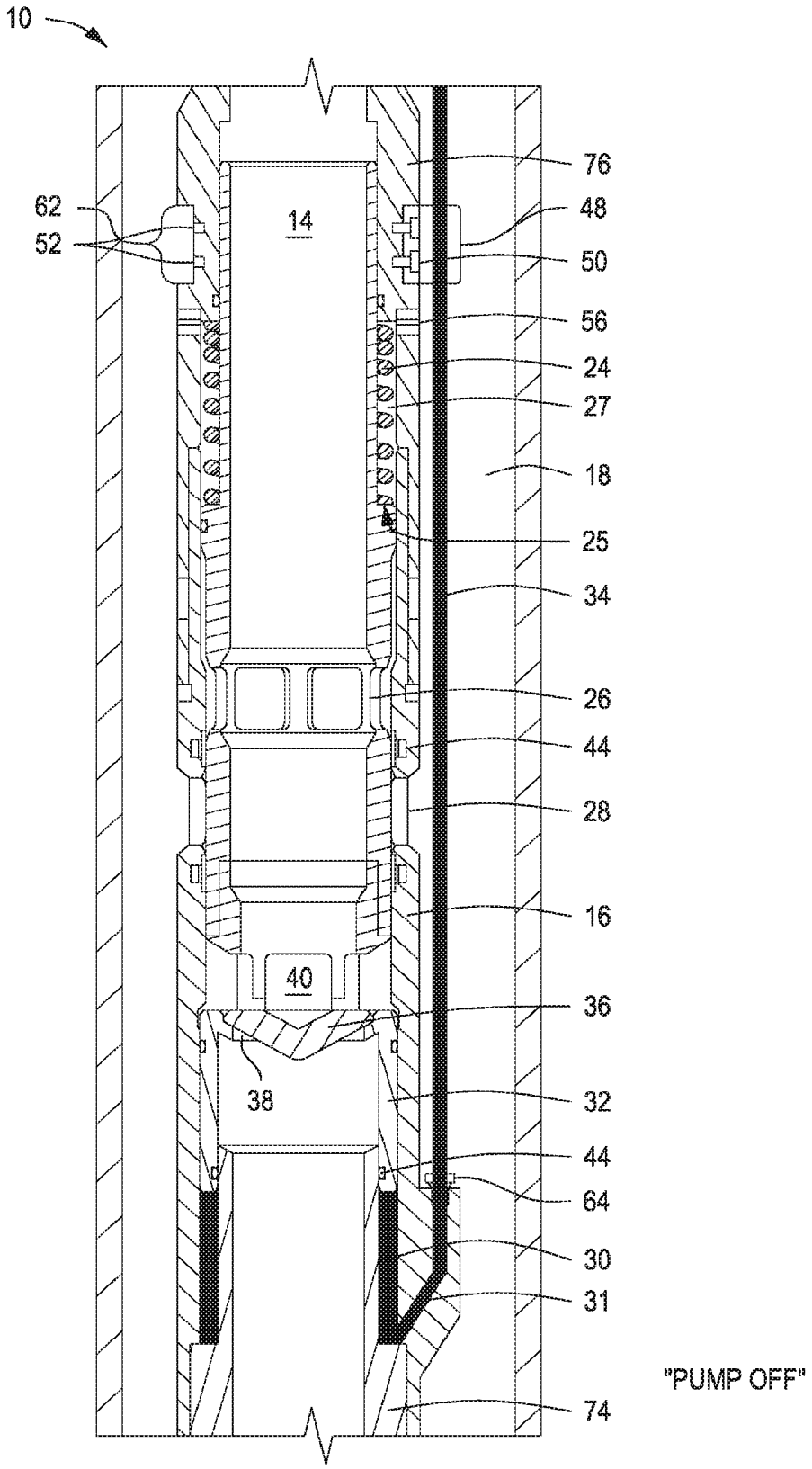
FIG. 4 is a simplified, cutaway view of a structure that includes a hydraulically closed bypass valve.

Referring generally to FIGS. 2-4, a hydraulic bypass valve is shown in either a closed position or an open position. In FIGS. 2 and 3, the ESP and spring tension may passively control (the flow of fluid controls rather than hydraulic actuation) the movement of the shuttle 14 and, therefore, the state of the hydraulic bypass valve (open or closed). In FIG. 4, the hydraulic bypass valve may be closed using hydraulic actuation forces described below.

Referring to FIG. 2, a simplified, cutaway view of a hydraulic bypass valve positioned downhole is depicted with the ESP running and the hydraulic bypass valve having isolated the annulus 18. The pressure generated by fluid movement caused by the ESP against the shuttle nose 36 may lift the shuttle 14 off the sealing surface 38, thereby shifting the vertical position of side wall 15 and closing the connection between production tubing and annulus 18 that previously existed through shuttle port 26 and shuttle housing port 28. The shuttle 14 may be raised by the force of the fluid passing through the ESP and against the shuttle nose 36, and the shuttle nose 36 may no longer be in contact with the sealing surface 38 of the floating seat 32. The fluid pressure generated by the ESP may be sufficient to overcome the forces exerted by a spring 24 on the radial face 25 of the shuttle 14, compressing the spring 24 and moving the shuttle 14 upward with respect to the shuttle housing.

The spring 24 may be positioned between the shuttle 14 and the top sub 76 & center housing 16. The spring 24 may exist in a compressed state and presses against a radial face 25 of the shuttle 14 and the top sub 76. When the ESP is on, the fluid flowing toward the surface from the ESP may push against the shuttle nose 36 and lift the shuttle 14 from the sealing surface 38, compressing the spring 24. When the ESP is off, the spring 24 may exert a force on the shuttle 14 and cause the shuttle nose 36 to press into the sealing surface 38 of the floating seat 32, preventing fluid from entering the ESP.

The hydraulic mechanism gives the hydraulic bypass valve the ability to isolate the production tubing from the annulus 18 using hydraulic pressure when the ESP is off. Within housing 11, the floating seat 32 comprises a first circumferential face 35, a second circumferential face 33, and a side wall 37. Floating seat 32 may be in one of two positions: lifted and lowered. The floating seat 32 is "lowered" when the hydraulic pressure against the walls defining the hydraulic fluid cavity 30, including side wall 29 and radial face 75 of housing 11, is not sufficient to overcome the forces exerted by the spring 24 on the shuttle 14. The floating seat 32 is "lifted" when hydraulic pressure against the walls of the hydraulic fluid cavity 30 is increased through the hydraulic line 34 to cause the hydraulic pressure to be sufficient to overcome the forces exerted by the spring on the shuttle 14. This increase in hydraulic pressure against the walls defining the hydraulic fluid cavity 30 may cause the volume of the hydraulic fluid cavity 30 to increase by pressing against first circumferential surface 35 of the floating seat 32, thereby moving the shuttle 14 upward in the shuttle housing. The amount of hydraulic pressure needed to lift the floating seat 32 varies depending in a number of factors including, but not limited to: wellbore depth, spring modulus, and flow rate of the pump.

Referring now to FIG. 3, a simplified, cutaway view of a hydraulic bypass valve positioned downhole is depicted when the ESP is not running. The hydraulic bypass valve 10 is in a closed position, which may permit fluid to travel upward or downward within the well without entering the ESP. For example, formation fluids may flow upward to the surface through the well without the aid of a pump when the formation is pressurized. Also, for example, formation fluids may flow upward toward the surface when a secondary ESP positioned below the primary ESP is running instead of the primary ESP. In both cases, the primary ESP is not needed. In the configuration depicted in FIG. 3, the shuttle 14 may be positioned in a manner such that the shuttle nose 36 is touching the sealing surface 38 of the floating seat 32. This ensures that fluid or solids in the production tubing that flow through the shuttle 14 do not pass through the ESP. The spring 24 positioned between the center housing 16 and the top sub 76 pushes the shuttle 14 downward against the sealing surface 38 of the floating seat 32. The spring 24 may be able to maintain a seal between the shuttle nose 36 and the sealing surface 38 even while production fluids travel upward from the formation.

After the ESP has been turned off, gravity may cause any fluid remaining in the production tubing to drain downward back into the formation. If the production tubing is still in communication with the ESP, the solids found in the fluid may enter the ESP and potentially damage moving parts of the ESP. Opening the bypass valve may permit this fluid to drain into the annulus to the formation rather than through the ESP. When the ESP is shut off and fluid is no longer being pumped upward, the spring 24 may push the shuttle 14 toward the ESP. The shuttle nose 36 may then touch the sealing surface 38 of the floating seat 32. This ensures that the production fluid flowing downward through the shuttle 14 does not pass through the ESP once the ESP has been turned off, but rather out of the hydraulic bypass valve through shuttle port 26 and shuttle housing port 28 into the annulus 18.

Referring to FIG. 4, a simplified, cutaway view of a hydraulic bypass valve is depicted in a hydraulically-induced, closed position when the ESP is not running. Closing the hydraulic bypass may isolate the ESP and annulus, and fluid can be pumped down the production tubing and pressurized to test the integrity of the production tubing. The production tubing may in some cases not be in fluid communication with the ESP when the shuttle nose 36 is seated on the sealing surface 38 of the floating seat 32. Also, the production tubing may not be in fluid communication with the annulus when the floating seat 32 is lifted to raise the shuttle 14 such that the shuttle port 26 does not align with the shuttle housing port 28. The position of the floating seat 32 in the lower portion of the shuttle housing may change when using hydraulic pressure as described above.

Figures 5A, 5B:
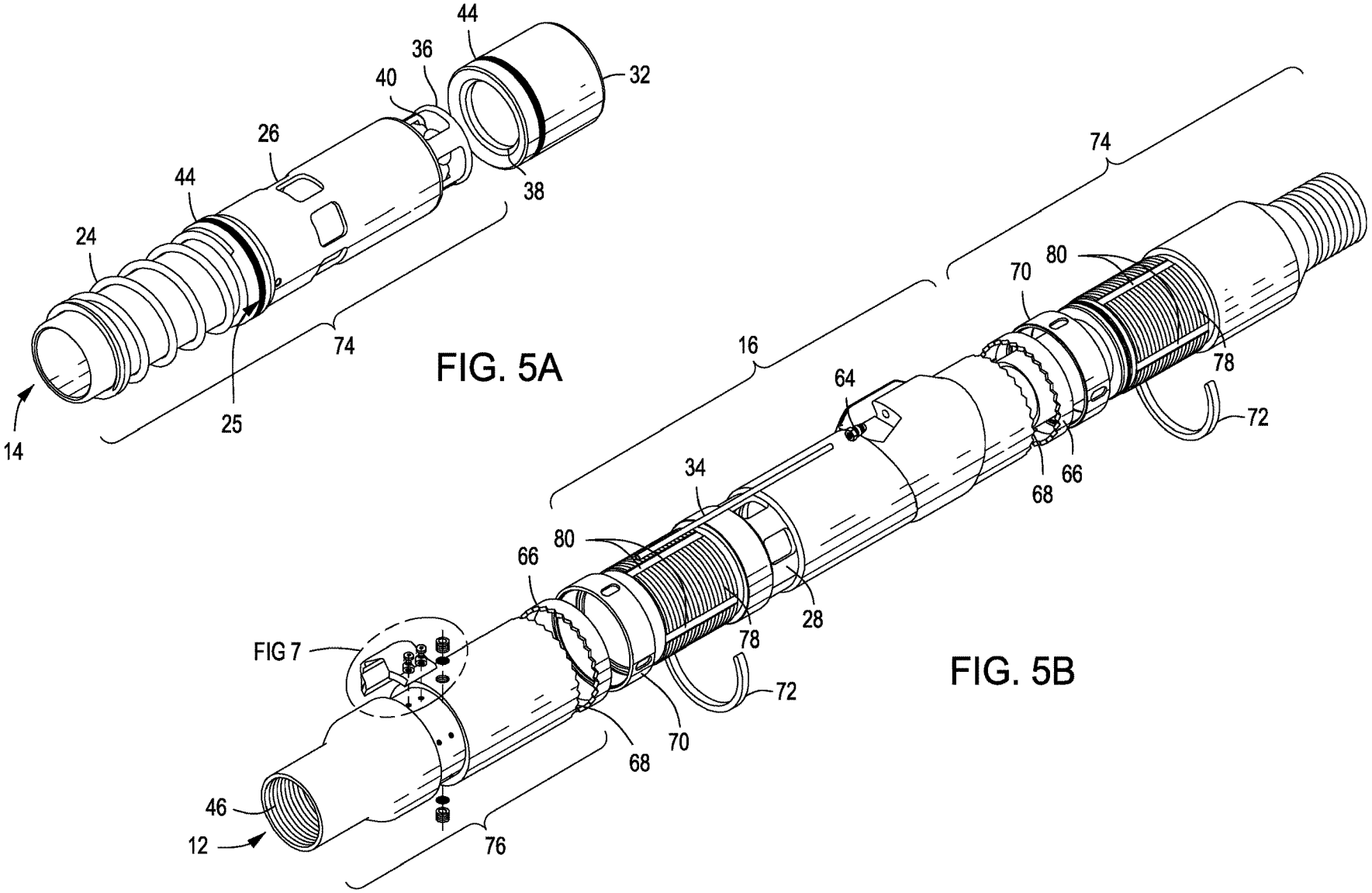
FIG. 5A is a perspective view of a structure that includes a hydraulic bypass valve shuttle as well as other components.
FIG. 5B is a perspective, exploded view of a structure of a number of components of a hydraulic bypass valve including a center housing, a top sub, and a bottom sub.

Referring to FIG. 5A, a perspective view of a shuttle 14 and a floating seat 32 of a hydraulic bypass valve is shown without the shuttle housing (12, FIG. 5B). The shuttle 14 and the components that move the shuttle upward and downward within the shuttle housing can be seen in this Figure. An ESP, when running, may cause fluid to pump upward through the floating seat 32, which lifts the shuttle nose 36 from the sealing surface 38. The fluid then flows around the nose 36 and through the nose opening 40 to pass through the shuttle 14 and into the production tubing. When positioned in the shuttle housing (12, FIG. 5B), spring 24 may press against a radial face 25 of the shuttle 14 so that the shuttle nose 36 is forced against the sealing surface 38 of the floating seat 32. The spring 24 pressing the shuttle 14 down against the sealing surface 38 may cause the shuttle port 26 to align with the shuttle housing port (28, FIG. 5B) when the shuttle 14 is positioned within the shuttle housing, opening the hydraulic bypass valve. Increased hydraulic pressure against the floating seat 32 may cause the floating seat 32 to lift with respect to the shuttle housing, increasing the volume of the hydraulic fluid cavity (30, FIG. 2). The increased hydraulic pressure may produce a force great enough to overcome the force exerted by the spring 24 on the shuttle 14, which may compress the spring 24 and lifts the shuttle 14. The shuttle 14 lifting may cause the shuttle port 26 to move upward so that it no longer overlaps with shuttle housing port 28, which may interrupt fluid communication between the production tubing and the annulus. Spring 24 may be positioned over a circumferentially smaller section of the shuttle 14 such that the shuttle 14 and the spring 24 have approximately the same outer diameter and are capable of be positioned within a shuttle housing (12, FIG. 5B). Seals 44 may prevent fluid from passing on the outside of the floating seal 32 and shuttle 14 when they are positioned inside the shuttle housing and bottom sub.

Referring to FIG. 5B, a perspective, exploded view of a shuttle housing 12 including a center housing 16, top sub 76, lower sub 74, and connection components of a hydraulic bypass valve are depicted. When assembled, the shuttle (14, FIG. 5A) would be positioned within the center housing 16, bottom sub 74, and top sub 76. The top sub 76 and bottom sub 74 may be coupled to the center housing 16 using a threaded connection 100 (Piranha Lock™). The threaded connection 100 may use a number of components to secure a connection between two tubulars so that they cannot rotate with respect to one another. The top sub 76 may be secured onto the center housing 16 using components of the threaded connection 100: the anti-rotation ring 66, the threaded lock ring 70, and the snap ring 72. The threaded lock ring 70 may be screwed down to the bottommost portion of the outer threaded surface 78. Then, the anti-rotation ring 66 (which has no threads) may be slid onto the outer threaded surface 78 until the anti-rotation ring 66 is immediately adjacent to the threaded lock ring 70; protrusions (not shown) on the inner surface of the anti-rotation ring 66 engage slots 80 present on the outer threaded surface 78. Then, the inner threaded surface (not shown) of the top sub 76 may be screwed onto the outer threaded surface 78 of the center housing 16 until the toothed face 68 of the top sub 76 stops. Then, the anti-rotation ring 66 may be slid towards the toothed face 68 of the top sub 76 until the teeth of the anti-rotation ring 66 fully engage the toothed face 68 of the top sub 76. Then, the threaded lock ring 70 may be "unscrewed" to move back toward the anti-rotation ring 66 until the threaded lock ring 70 is flush against the anti-rotation ring 66. This may leave a gap on the outer threaded surface 78 beneath the threaded lock ring 70. Finally, a snap ring 72 may be hammered into the gap to secure all components in position. The top sub 76 may now be incapable of rotating with respect to the center housing 16. Additional details on the threaded connection shall be discussed later in this disclosure.

Continuing with FIG. 5B, the top sub 76 includes a second threaded inner surface 46 that may be used to couple the top sub 76 to a production tubing string. The top sub 76 also includes an area where a cable clip may be attached (see inset, FIG. 7) to hold a hydraulic cable 34, a MLE (not shown), and/or other lines (i.e. for chemical injection) against the hydraulic bypass valve. The bottom sub 74 may also have a threaded inner surface (not shown) to screw onto a tubing string, or it may have a flange connection to connect directly to an ESP. The bottom sub 74 may have a portion (seen under items 66, 70) that has a smaller circumference than the rest of the bottom sub 74; this portion may be sized so that the floating seat (32, FIG. 5A) is capable of being positioned over this smaller portion. Similar to the top sub 76 and center housing 16 connection described above, the thread pipe connection 100 is also used to couple the center housing 16 to the bottom sub 74. The bottom sub 74 may include an outer threaded portion 78 onto which another anti-rotation ring 66 and threaded lock ring 70 are positioned and onto which the center housing 16 is screwed. The center housing 16 has a toothed face 68 that engages the teeth of the anti-rotation ring 66, similar to the toothed face 68 of the top sub 76 described above. The center housing 16 may include a shuttle housing port 28 which aligns with the shuttle port 26 when the hydraulic bypass valve is closed, permitting fluid passage from the production tubing to the annulus. The center housing 16 may also include a section that helps form the hydraulic fluid cavity (30, FIG. 2) when assembled with the floating seat and bottom sub 74. Hydraulic line 34 may connect to the hydraulic fluid cavity through an opening, and the hydraulic line 34 may be secured by a ferrule set 64 to that opening.

Figures 6A, 6B:
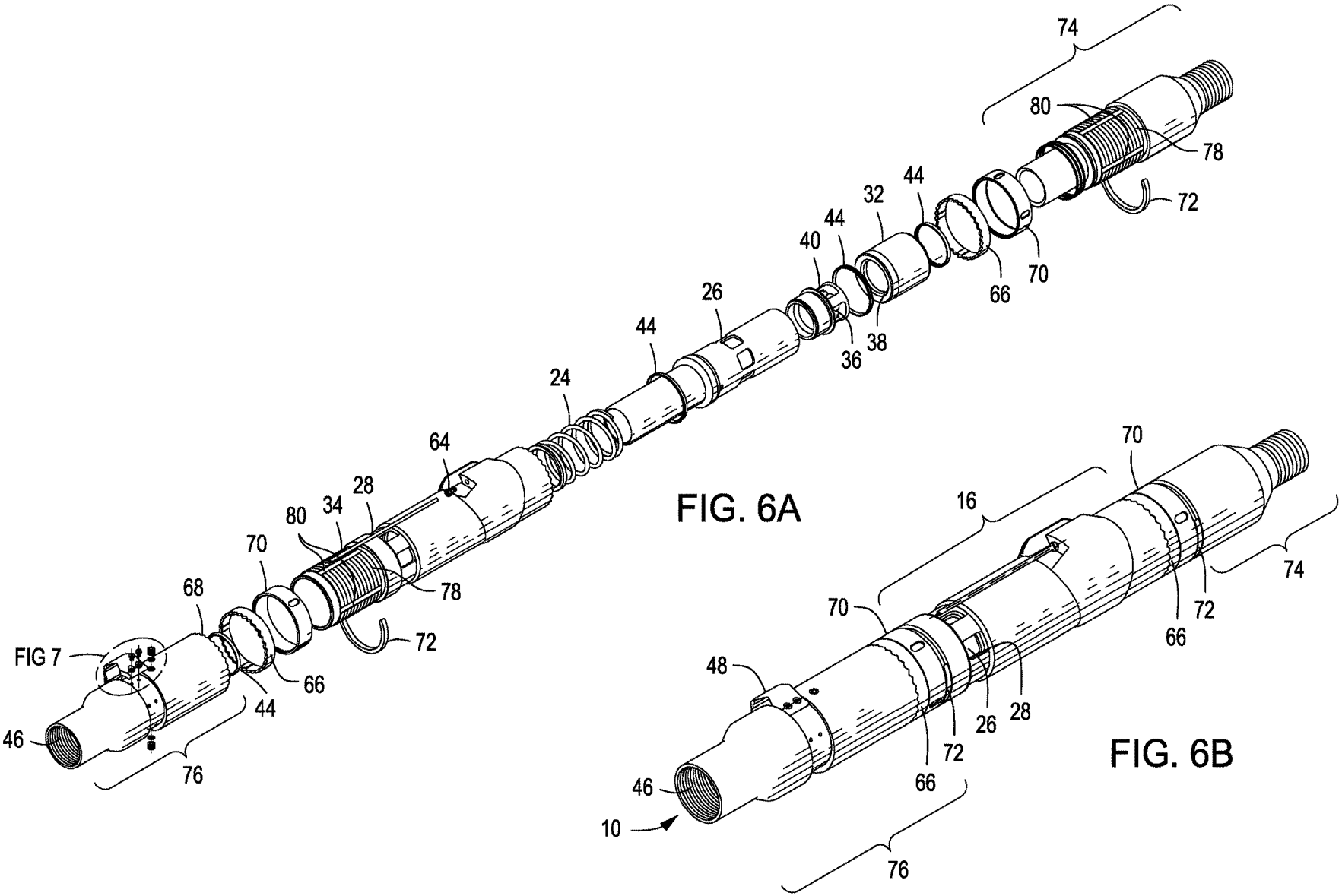
FIG. 6A is a perspective, exploded view of a structure that includes a hydraulic bypass valve with the shuttle positioned within the shuttle housing.
FIG. 6B is a perspective view of a structure that includes an assembled hydraulic bypass valve with the shuttle positioned within the shuttle housing.

Referring to FIGS. 6A and 6B, a perspective view of a hydraulic bypass valve is depicted. In FIG. 6A, the hydraulic bypass valve is shown in an exploded configuration, and the center housing 16, top sub 76, bottom sub 74, and shuttle 14 are each visible. In FIG. 6B, the hydraulic bypass valve is shown in an assembled state, and the shuttle is not visible within the center housing 16, top sub 76, and bottom sub 74. The exploded view better clarifies where the spring cavity (30, FIG. 2) exists in the assembled hydraulic bypass valve—the spring cavity may be found inside the threaded connection between the top sub 76 and the center housing 16. An opening (58, FIG. 7) connects the annulus to the spring cavity to prevent pressurization of the spring cavity during compression and decompression of the spring 24. The exploded view also better clarifies where the hydraulic fluid cavity (27, FIG. 2) exists in the assembled hydraulic bypass valve—the hydraulic fluid cavity is in the center housing 16 just above the threaded connection between the center housing 16 and the bottom sub 74. The hydraulic line 34 may be connected to the hydraulic fluid cavity and secured to the cavity using ferrule set 64.

Figure 7:
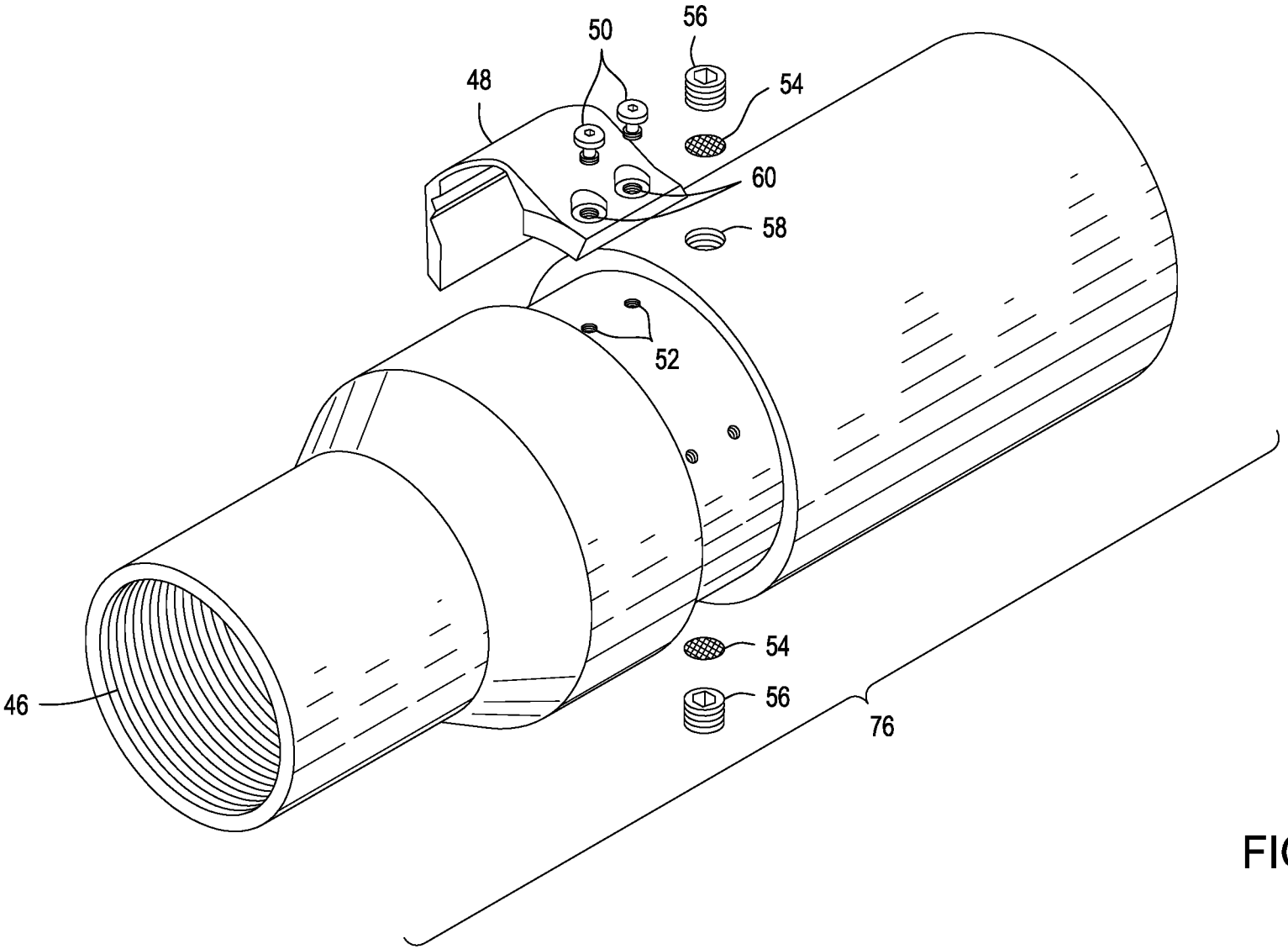
FIG. 7 is a perspective, exploded view of a portion of a hydraulic bypass valve, as indicated in FIG. 6A, detailing a number of smaller components.

Referring now to FIG. 7, a perspective view of an upper portion of a specific version of a top sub of a hydraulic bypass valve is shown. Visible in this view is threading 46 positioned on the inner surface of the top sub 76 of the hydraulic bypass valve, which may be used to couple the hydraulic bypass valve to a production tubing string (19, FIG. 1) positioned above the hydraulic bypass valve. Cable clip 48 is also shown in greater detail—the cable clip 48 may be coupled to the outer surface of the top sub 76 in an inset 62. The inset 62 may allow the opening of the cable clip 48 through which the ESP power cable and/or the hydraulic cable passes to sit flush to the outer surface of the shuttle housing 16. This allows the power cable and/or hydraulic cable (34, FIG. 2) to be coupled immediately against the outer surface of the top sub 76 which minimizes the risk of damage and movement to the power cable and/or hydraulic cable. Cable clip 48 may be coupled within the inset 62 of the top sub 76 using two clip bolts 50 which pass through cable clip holes 60 in the cable clip 48 and thread into clip bolt holes 52 positioned in the inset 62. Additional clip bolt holes 52 may be present in the inset to allow for greater flexibility in positioning the cable clip 48 at different angles around the top sub 76, and the additional clip bolt holes 52 may also be used to attach a second or even third cable clip 48 to the top sub 76 if needed. A threaded lock nut hole 58 may be positioned radially through the top sub 76 creates a fluid connection between the wellbore annulus and the spring cavity (not shown) to allow annular fluid to pass in and out of the spring cavity. Compression and decompression of the spring (and thus spring cavity) may be performed without causing positive or negative pressure in the spring cavity due to this fluid connection. A mesh 54 positioned to cover the lock nut hole 58 may be used to prevent solids that may be present in the annular fluid from entering the spring cavity and damaging or otherwise interfering with the compression and decompression of the spring. The mesh 54 may be held in place by a threaded lock nut 56 that has a cavity passing through the center axis of the threaded lock nut 56 to connect the annulus to the spring cavity.

Figure 8:
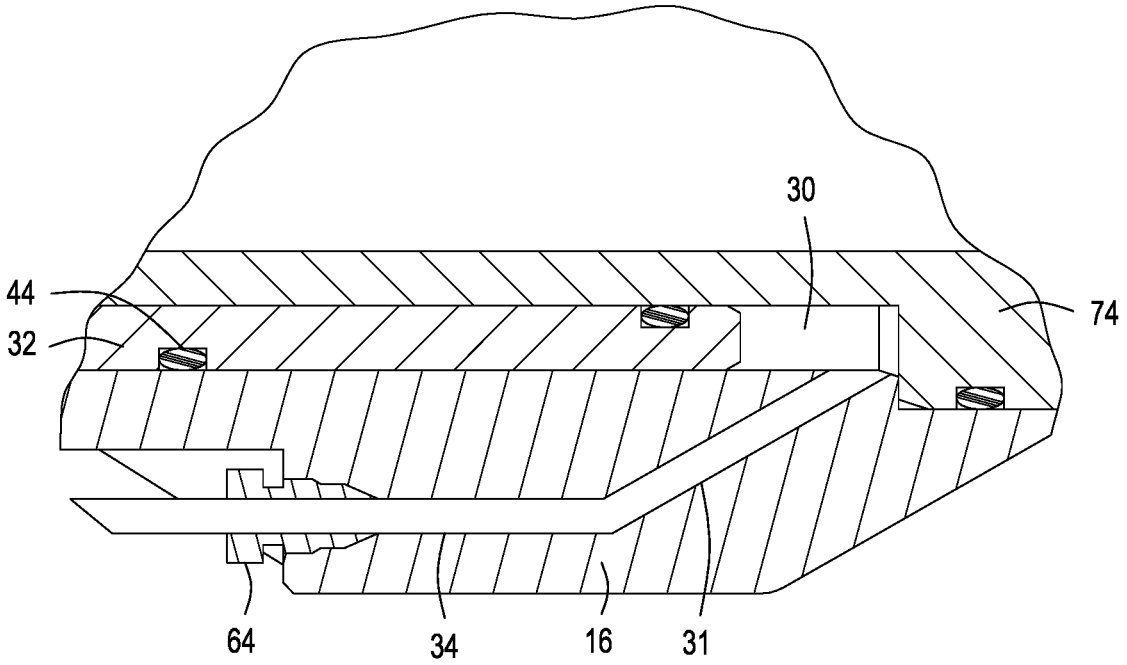
FIG. 8 is a detailed view of a hydraulic mechanism including a floating seat and a bottom sub.

Referring now to FIG. 8, a simplified, cutaway view of a portion of a hydraulic bypass valve is depicted. A ring-shaped hydraulic fluid cavity 30 may be formed by surfaces of three components of the hydraulic valve: the floating seat 32, the bottom sub 74, and the center housing 16. A hydraulic fluid channel 31 may be found within the side wall of the center housing 16. A hydraulic cable 34 may be connected to the hydraulic fluid channel 31 using jam nut and ferrule set 64. Hydraulic fluid may travel to the hydraulic fluid cavity 30 by traveling through the hydraulic cable 34, through the hydraulic fluid channel 31, and into the hydraulic fluid cavity 30.

Turning to the details of the Piranha Lock™, FIGS. 9-10 and 11A-11F illustrate examples of thread pipe connections for use with the disclosed apparatuses. These figures may show features which may be found in various specific versions, including both versions shown in this specification and those not shown.

Figure 9:
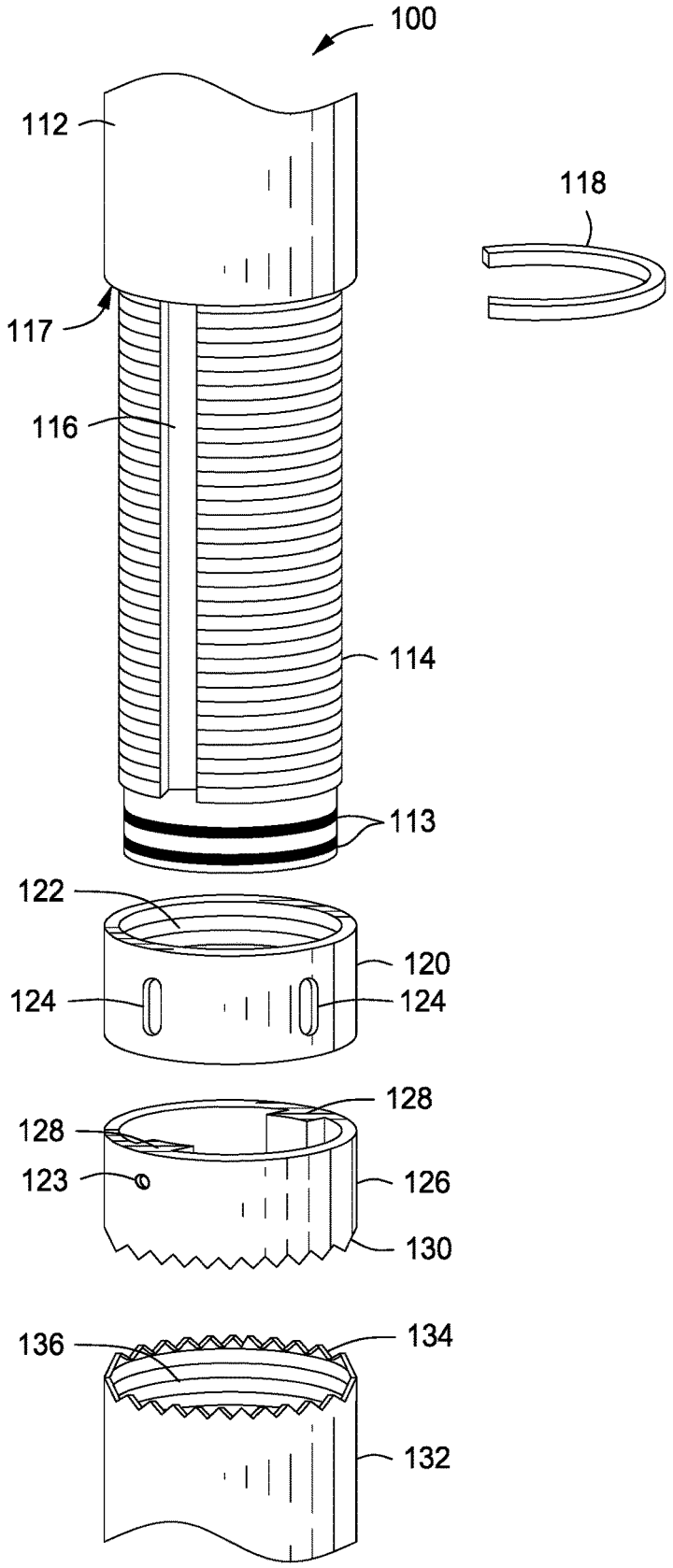
FIG. 9 is an exploded view of a simplified depiction of a pipe connection.

In FIG. 9, a simplified exploded view of a specific version of a pipe connection 100 is depicted. The threaded connection 100 includes first pipe 112 and second pipe 132, connected preferably as shown in the drawings. The first pipe 112 may have a male threaded portion 114, e.g., having some threads on the outside surface of the first pipe 112. The first pipe 112 may also include one or more seals 113 that may be positioned near a section of the male threaded portion 114. The second pipe 132 may have a female threaded portion 136 comprising threads on the inside surface of the female threaded body 132. The threads of the male threaded portion 114 may be capable of engaging the threads of the female threaded end 136 and rotating to couple the male threaded portion 114 to the female threaded portion 136, e.g., by screwing them together. The number of threads per longitudinal inch of the male threaded portion 114 and the number of threads per longitudinal inch of the female threaded portion 136 are preferably identical. The second pipe 132 may have a circumferential toothed face 134 wherein the teeth of the toothed face 134 are directed axially toward the first pipe 112 when the pipes 112, 132 are coupled. Threaded connection 100 may also include a threaded lock ring 120 which may have an inner threaded surface 122 and slots 124 in the outer surface of the threaded lock ring 120. The slots 124 are indentations, and each slot has a depth that may be less than the thickness of the threaded lock ring 120. The slots may be capable of being engaged by a tool (not shown) that is capable of engaging the slots, so that the tool can be used as a handle to rotate the threaded lock ring 120. The inner threaded surface 122 of the threaded lock ring 120 may be capable of engaging the threads of the male threaded portion 114 and rotating to couple the threaded lock ring 120 to the male threaded portion 114. The number of threads per longitudinal inch of the male threaded portion 114 and the number of threads per longitudinal inch of the threaded lock ring 120 are preferably identical. The threaded lock ring 120 is coupled to the first pipe 112 before the first pipe 112 is coupled to the second pipe 132, as discussed below.

The threaded connection 100 may also include an anti-rotation ring 126, which can be coupled to the first pipe 112, as described below. The first pipe 112 may include one or more grooves 116 on the outer surface of the first pipe 112 preferably on the threaded portion 114. The grooves 116 run in an axial direction and are substantially perpendicular to the threading of the male threaded end 114. The grooves 116 may be substantially perpendicular to the shoulder 117 of the first pipe 112. The grooves 116 may be inset radially such that the grooves 116 are positioned more radially inset (deeper) than the threads of the male threaded end 114, i.e., have greater depth than the threads. The grooves 116 should be capable of receiving one or more protrusions 128 that may be found on the inner surface of the anti-rotation ring 126, preferably in order to prevent or inhibit the anti-rotation ring 126 from rotating with respect to the first pipe 112. The height of the protrusions 128 may correspond to the radial depth of the grooves 116. For example, the height of the protrusions 128 may be equal to or less than the radial depth of the grooves 116.

Figure 10:
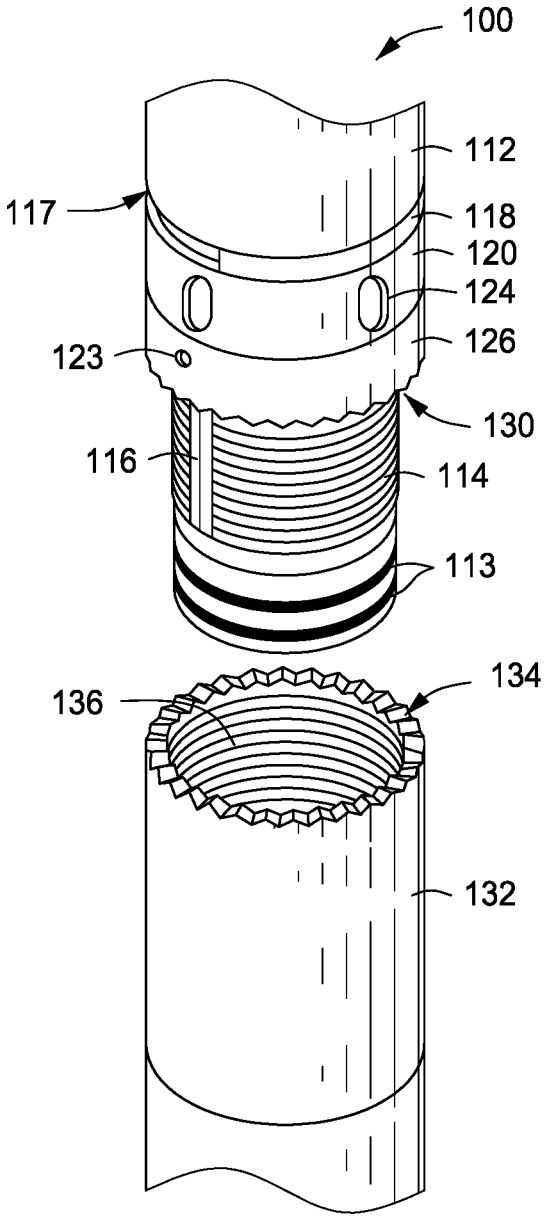
FIG. 10 is a simplified depiction of a pipe connection showing various elements prior to connection.

The anti-rotation ring 126 may include a toothed face 130 wherein the teeth of toothed face 130 are directed axially toward the second pipe 132 when the first and second pipes 112, 132 are coupled. The toothed faces 130, 134 may include single-angle, straight teeth wherein each tooth is approximately symmetrical along a plane perpendicular to the tooth base that passes through the tooth peak. The anti-rotation ring 126 may have a threaded hole 123 passing radially through the walls of the anti-rotation ring 126 into which a screw (not shown) may be inserted. After anti-rotation ring 126 is positioned onto the first pipe 112 (e.g., on the threaded portion 114 as seen in FIG. 10), the screw may be screwed into the threaded hole 123 so that it presses against the male threaded portion 114 and holds the anti-rotation ring 126 at a particular position along the male threaded portion 114. The threaded hole 123 may be aligned with the groove 116 such that, when inserted, the screw presses against the bottom portion of the groove 116. The number of grooves 116 in the male threaded portion 114 and the number of protrusions 128 on the anti-rotation ring 126 are preferably the same. At least some of the above-described components of the threaded connection 100 may include metal, e.g., low alloy steel.

Referring now to FIG. 10, a simplified depiction of a threaded connection 100 is illustrated. When the threaded connection 100 is assembled, the threaded lock ring 120 may be positioned on and engaged with the male threaded portion 114. After the threaded lock ring 120 is screwed onto the male threaded end 114, the anti-rotation ring 126 may be positioned on the male threaded portion 114 such that the protrusions 128 are positioned in the grooves 116 and the toothed face 130 is directed away from the threaded lock ring 120. The anti-rotation ring 126 may held at a particular axial position with relation to the male threaded portion 114 by the screw (not shown) inserted into the threaded hole 123. After positioning the anti-rotation ring 126 on the male threaded portion 114, the second pipe 132 may be coupled to the first pipe 112 by engaging the threads of the female threaded end 136 with the threads of the male threaded portion 114.

Figure 11A:
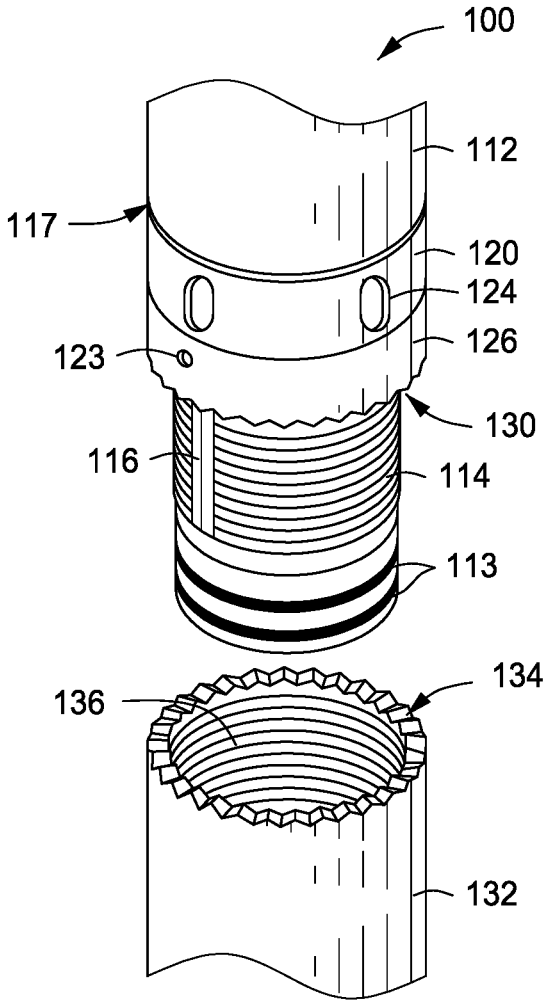
FIGS. 11A-11F are simplified depictions demonstrating one or more methods of forming the pipe connection.

Referring to FIGS. 11A-11F, the figures depict an exemplary sequence for assembling a threaded connection 100. In FIG. 11A, the threaded lock ring 120 and the anti-rotation ring 126 may be positioned on the male threaded end 114 of the first pipe 112. The threaded lock ring 120 may be screwed onto and positioned so as to abut the shoulder 117 of the first pipe 112. The anti-rotation ring 126 may be positioned on the male threaded portion 114 and abut the threaded lock ring 120, leaving a portion of the male threaded portion 114 available for coupling to the female threaded portion 136. The threading of the male threaded portion 114 substantially corresponds to the threading of the female threaded portion 136 in width and spacing.

Figure 11B:
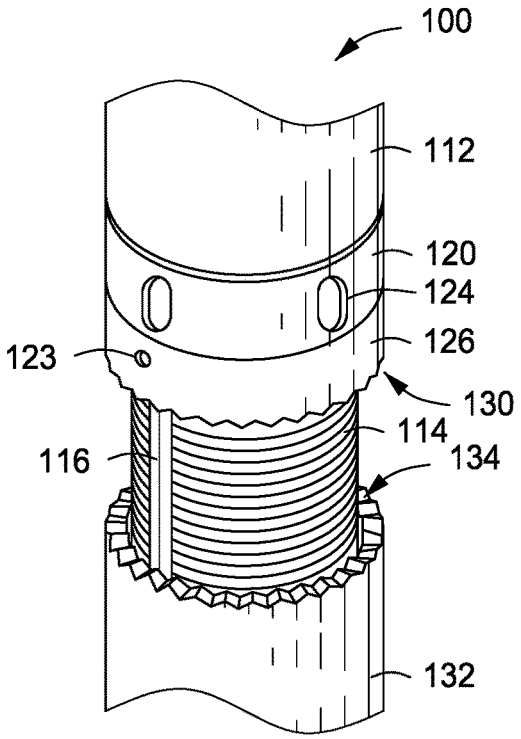

In FIG. 11B, the second pipe 132 may be coupled to the first pipe 112 when the female threaded portion 136 engages the male threaded portion 114. The female threaded portion 136 and the male threaded portion 114 may be engaged by screwing the mating threads together. The second pipe 132 may be screwed onto the male threaded portion 114 to a point where the second pipe 132 cannot be advanced on the male threaded portion 114 any further. The second pipe 132 may be screwed onto the male threaded portion 114 to a position chosen by an operator. An operator may change the axial effective position of the border between the male threaded portion 114 and a non-threaded portion of the first pipe 112, e.g., by adding a second threaded ring (not shown) between the threaded lock ring 120 and the shoulder 117 of the first pipe 112.

Figure 11C:
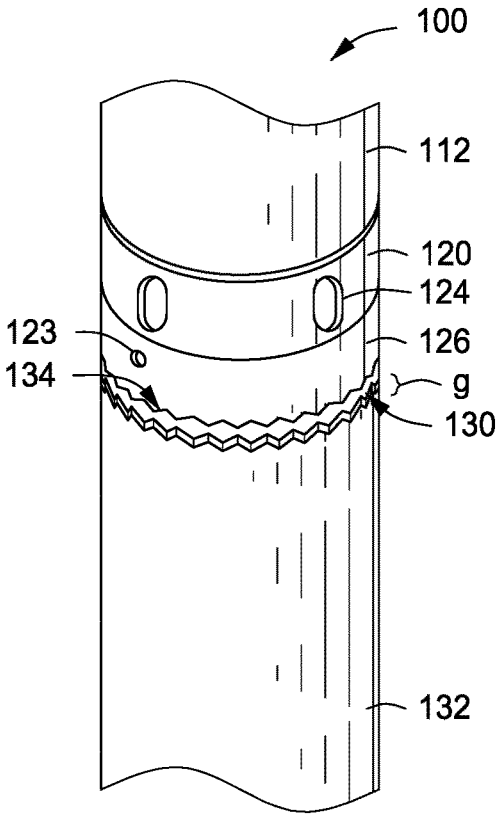

Referring now to FIG. 11C, the toothed face 134 of the second pipe 132 is shown as approaching the toothed face 130 of the anti-rotation ring 126. The circumferential position of the toothed face 130 of the anti-rotation ring 126 is fixed with respect to the first pipe 112 when the protrusion 128 is engaged with the groove 116. Therefore, for the toothed face 134 of the second pipe 132 to align with the toothed face 130 of the anti-rotation ring 126, the second pipe 132 may need to be rotated, e.g., such as when threaded onto the first pipe 112. After aligning the toothed faces 130, 134, the anti-rotation ring 126 may be capable of "fully engaging" the second pipe 132, i.e., the toothed face 134 of the second pipe 132 would be positioned such that the peaks of the toothed face 134 are positioned immediately adjacent to the valleys of the teeth of the toothed face 130 of the anti-rotation ring 126. Alternatively, the second pipe 132 may be rotated to misalign the toothed faces 130, 134, i.e., axially align the peaks of the teeth of the toothed faces 130, 134. In this instance, sliding the anti-rotation ring 126 to be adjacent to the second pipe 132 would form a gap with a distance "g" between the two toothed faces 130, 134. By rotating the second pipe 132 with respect to the first pipe 112, the gap "g" may be closed by partially or completely aligning the toothed faces 130, 134. The number of teeth around the circumference of the toothed face 130 of the anti-rotation ring 126 is preferably the same as the number of teeth around the circumference of the toothed face 134 of the second pipe 132.

Figure 11D:
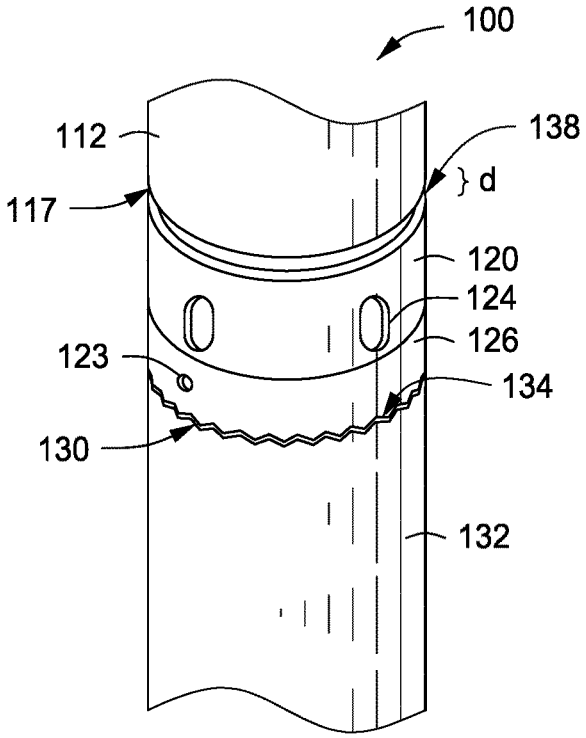
Figure 11E:
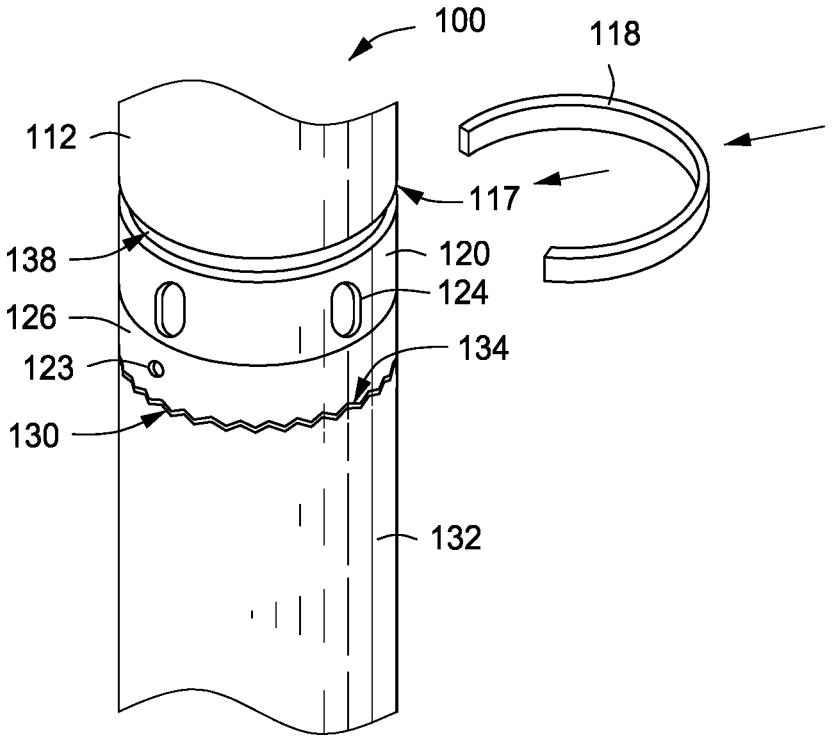
Figure 11F:
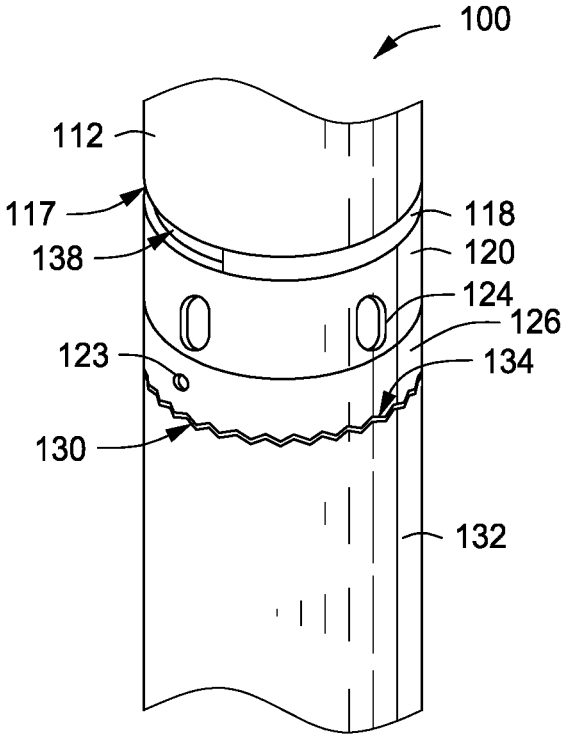

Referring now to FIG. 11D, the threaded connection between the female threaded portion (not shown) and the male threaded portion (not shown) may be untightened (loosened), adjusted, then re-tightened as needed until the toothed face 130 of the anti-rotation ring 126 and the toothed face 134 of the second pipe 132 are aligned (the peak of each tooth of one toothed face is substantially axially in-line with the valley of each corresponding tooth of the second toothed face). Higher numbers of teeth per circumferential inch may require less adjustment to align the toothed faces 130, 134. The anti-rotation ring 126 may be positioned adjacent to the toothed face 134 of the second pipe 132 by sliding the anti-rotation ring 126 longitudinally along the male threaded portion 114. When sliding the anti-rotation ring 126, the protrusions (not shown) of the anti-rotation ring 126 remained engaged with the grooves (not shown) of the male threaded portion 114. Prior to positioning the anti-rotation ring 126, the screw may be removed from the threaded hole 123 to permit axial movement of the anti-rotation ring 126. After the anti-rotation ring 126 is positioned against the toothed face 134 of the second pipe 132, the threaded lock ring 120 may be positioned along the male threaded portion 114 to be immediately adjacent to and abutting the anti-rotation ring 126. The anti-rotation ring 126 may be prevented from moving longitudinally with respect to the first pipe 112. The teeth of the toothed face 130 of the anti-rotation ring 126 may be fully engaged with the teeth of the toothed face 134 of the second pipe 132. The distance "d" between the shoulder 117 of the first pipe 112 and the threaded lock ring 120 forms a gap 138 between the shoulder 117 of the first pipe 112 and the threaded lock ring 120. The width of the gap 138 may be adjusted by altering distance "d" after the toothed face 130 of the anti-rotation ring 126 and the toothed face 134 of the second pipe 132 are fully engaged (e.g., by unscrewing the male threaded portion 114 from the female threaded end 136). The distance "d" between the shoulder 117 of the first pipe 112 and the threaded lock ring 120 may be predetermined by the width of a gap ring (118, FIG. 11D) that is to be coupled with the first pipe 112. The distance "d" may be approximately equal to the distance "g" described above.

Referring now to FIGS. 3E and 3F, after the preferred gap 138 width is determined and set, the snap ring 118 may be coupled to the first pipe 112, for example, by being hammered into place around the circumference of the first pipe 112. The snap ring 118 may include a material capable of elastic deformation, e.g., a metal, preferably spring steel, capable of deforming to increase the diameter of the snap ring 118 when a force is applied and capable of returning a shape substantially identical to the snap ring 118 shape prior to deformation. The thickness of the snap ring 118 may be approximately equal to the width of the gap 138 such that the gap 138 is at least partially filled by the snap ring 118 in a manner that prevents substantially all axial movement of the threaded lock ring 120. The snap ring 118 may have an inner diameter substantially equal to the diameter of the male threaded end 114 of first pipe 112. The snap ring 118 may be substantially arc shaped, such that the arc of the inner face of the snap ring 118 measures between 180-295 degrees. The snap ring 118 may be incapable of uncoupling with the first pipe 112 with human hands alone. The snap ring 118 may be capable of removal from the using a mating profile tool and a hammer using methods that are well known in the art.

When in a locked position, the anti-rotation ring 126 may serve to couple first pipe 112 (e.g., a male coupling body) and the second pipe 132 (e.g., a female coupling body) in a manner that prevents rotational movement relative to one another. The anti-rotation ring 126 may be coupled to the first pipe 112 in a manner that prevents rotational movement between the anti-rotation ring 126 and the first pipe 112. The toothed face 130 of the anti-rotation ring 126 may be fully engaged with the toothed face 134 of the second pipe 132 in a manner that prevents rotational movement between the anti-rotation ring 126 and the second pipe 132. The strength of the couplings between the anti-rotation ring 126, the first pipe 112, and the second pipe 132 may be determined by a variety of factors including, but not limited to, the material strength of the parts used for manufacture, the number of teeth per circumferential inch on the toothed faces 130, 134, the height of the protrusion(s) 128 and the depth of the groove(s) 116, and the number of protrusions 128 and corresponding grooves 116.

What is claimed as the invention is:

1. A system for pressure testing of production tubing in an oil or gas well comprising:

a valve capable of being coupled to an electrical submersible pump (ESP) downhole in the oil or gas well, wherein the valve comprises:

a cylindrical housing having a first side wall and a bottom face, wherein a first channel is positioned radially through the first side wall, the cylindrical housing comprising a center housing, a top sub, and a bottom sub;

a first cylindrical body having a second side wall, wherein a second channel is positioned radially through the second side wall;

a second cylindrical body having a third side wall, a first circumferential face, and a second circumferential face; and a cavity that is defined by the first circumferential face, the first side wall, and the bottom face.

2. The system of claim 1 wherein the cavity contains fluid.

3. The system of claim 2 further comprising increasing the fluid pressure against the cavity and increasing the volume of the cavity.

4. The system of claim 3 wherein increasing the size of the cavity causes the second channel to not be aligned with the first channel, thereby closing a fluid connection between the production tubing and an annulus.

5. The system of claim 1 wherein the valve further comprises a conduit having a fluid connection with the cavity.

6. The system of claim 5 wherein fluid pressure against the cavity is increased through fluid in the conduit.

7. The system of claim 1 wherein the increase in fluid pressure in the cavity is sufficient to overcome a force applied by a spring on a radial face of the first cylindrical body.

8. The system of claim 1 wherein the top sub or bottom sub is coupled to the center housing using an anti-rotation threaded connection.

9. A system for pressure testing of production tubing in an oil or gas well comprising:

a valve capable of being coupled to an electrical submersible pump (ESP) downhole in the oil or gas well, wherein the valve comprises:

a cylindrical housing having a first side wall and a bottom face, wherein a first channel is positioned radially through the first side wall, the cylindrical housing comprising a center housing, a top sub, and a bottom sub;

a cylindrical body having a second side wall, a first circumferential face, and a second circumferential face, wherein a second channel is positioned radially through the second side wall;

a cavity that is defined by the first circumferential face of the cylindrical body, the first side wall, and the bottom face.

* * * * *